US012168848B2

(12) United States Patent
Park et al.

(10) Patent No.: US 12,168,848 B2
(45) Date of Patent: Dec. 17, 2024

(54) WASHING MACHINE

(71) Applicant: LG Electronics Inc., Seoul (KR)

(72) Inventors: Jungsik Park, Seoul (KR); Yanggyu Kim, Seoul (KR); Ilyoung Park, Seoul (KR); Sanghyun Joo, Seoul (KR); Jangseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 17/583,797

(22) Filed: Jan. 25, 2022

(65) Prior Publication Data

US 2022/0235514 A1 Jul. 28, 2022

(30) Foreign Application Priority Data

Jan. 25, 2021 (KR) ..... 10-2021-0010328

(51) Int. Cl.

*D06F 43/08* (2006.01)
*D06F 43/00* (2006.01)
*D06F 43/02* (2006.01)

(52) U.S. Cl.

CPC ..... *D06F 43/083* (2013.01); *D06F 43/005* (2013.01); *D06F 43/02* (2013.01); *D06F 43/085* (2013.01); *D06F 43/081* (2013.01)

(58) Field of Classification Search

CPC .... D06F 43/085; D06F 43/081; D06F 43/083; D06F 43/005; D06F 43/02

See application file for complete search history.

(56) References Cited

U.S. PATENT DOCUMENTS 6,412,312 B1 7/2002 McClain et al.
6,898,951 B2 * 5/2005 Severns ..... C11D 3/30 68/17 R
2002/0004954 A1 * 1/2002 Preston ..... D06F 43/00 134/107

(Continued)

FOREIGN PATENT DOCUMENTS

EP 2733257 5/2014
JP 2002509741 4/2002

(Continued)

OTHER PUBLICATIONS

Extended European Search Report in European Application No. 22153159.3, dated Jun. 15, 2022, 8 pages.

(Continued)

*Primary Examiner* — Benjamin L Osterhout
(74) *Attorney, Agent, or Firm* — Fish & Richardson P.C.

(57) ABSTRACT

A washing machine includes: a frame, a drum receiving laundry, a washing chamber including (i) a first housing defining an opening and a space into which the drum is inserted, (ii) a barrier surrounding the opening and coupled to the first housing, and (iii) a second housing surrounding a first surface of the barrier and coupled to the first housing, a storage tank receiving carbon dioxide to be supplied to the drum, a distillation chamber separating contaminants dissolved in liquid carbon dioxide, an electronic unit, and a configuration unit. The configuration unit includes a pipe moving the carbon dioxide, a first compressor and a second compressor compressing the carbon dioxide discharged after washing is completed in the drum and moving the compressed carbon dioxide into the storage tank, and an oil separator separating oil from the carbon dioxide compressed in the first compressor and the second compressor.

20 Claims, 25 Drawing Sheets

(56) References Cited

U.S. PATENT DOCUMENTS

| | | | | |
|---|---|---|---|---|
| 2004/0117919 | A1* | 6/2004 | Conrad | D06F 43/00 8/137 |
| 2005/0091757 | A1* | 5/2005 | Luckman | D06F 43/08 8/137.5 |
| 2005/0092033 | A1* | 5/2005 | Luckman | D06F 43/085 68/124 |
| 2005/0096243 | A1* | 5/2005 | Luckman | D06F 43/007 510/285 |
| 2005/0126606 | A1* | 6/2005 | Goedhart | D06F 43/007 134/42 |
| 2005/0150059 | A1 | 7/2005 | Luckman et al. | |
| 2005/0183208 | A1* | 8/2005 | Scheper | D06F 43/02 68/17 R |
| 2007/0277562 | A1 | 12/2007 | Uhlin | |
| 2013/0167558 | A1 | 7/2013 | Jassani et al. | |
| 2019/0186068 | A1 | 6/2019 | Kim et al. | |

FOREIGN PATENT DOCUMENTS

| | | |
|---|---|---|
| JP | 2005253853 | 9/2005 |
| KR | 20-0130726 | 4/1999 |
| KR | 20030040637 | 5/2003 |
| KR | 20030046506 | 6/2003 |
| KR | 100622260 | 9/2006 |
| KR | 20190128496 | 11/2019 |

OTHER PUBLICATIONS

International Search Report and Written Opinion in International Application No. PCT/KR2022/001265, dated May 30, 2022, 11 pages.

Office Action in Korean Appln. No. 10-2023-0085815, mailed on Jan. 30, 2024, 16 pages (with English translation).

* cited by examiner

WASHING MACHINE

CROSS-REFERENCE TO RELATED APPLICATION

This application claims priority to and the benefit of Korean Patent Application No. 10-2021-0010328, filed on Jan. 25, 2021, the disclosure of which is incorporated herein by reference in its entirety.

TECHNICAL FIELD

The present disclosure relates to a washing machine, and more particularly to a washing machine for performing laundry treatment using carbon dioxide ($CO_2$).

BACKGROUND

In a washing procedure and a rinsing procedure of a conventional washing machine designed to use carbon dioxide ($CO_2$), a washing tub of the washing machine is filled with gaseous carbon dioxide ($CO_2$) and liquid carbon dioxide ($CO_2$). In order to wash laundry using carbon dioxide ($CO_2$), carbon dioxide ($CO_2$) flows from a storage tub into the washing machine so that the inside of the washing machine can be filled with the carbon dioxide ($CO_2$). After completion of the washing procedure, carbon dioxide ($CO_2$) is drained from the washing tub to a distillation tub and then flows from the distillation tub into the storage tub, so that the carbon dioxide ($CO_2$) can be reused. In addition, the washing tub is generally designed in a manner that a pulley is connected to a drive shaft, and a motor pulley is connected to a drum pulley through a belt, so that a drum can rotate by the washing tub.

A conventional washing machine defines a washing space in which laundry is disposed and a motor space in which a motor is installed that are used together without distinction therebetween, so that the motor space is unavoidably filled with carbon dioxide ($CO_2$). As a result, the amount of carbon dioxide ($CO_2$) to be used in the washing procedure of laundry unavoidably increases. Also, due to the large amount of carbon dioxide ($CO_2$), pressure vessels related to carbon dioxide ($CO_2$) unnecessarily increase in size, and the system becomes very large in size and very heavy in weight, so that there are many restrictions on the space in which the system is to be installed. In addition, for the conventional washing machine, the drum cannot be taken out of the washing space, so that it is impossible to provide an operator (or a repairman) with an easy repair environment in which the drum can be easily repaired.

In association with constituent components of the conventional washing machine using carbon dioxide ($CO_2$), there is a great difficulty in easily maintaining/repairing the conventional washing machine. For example, in order for a user such as a repairman to disassemble a flange due to occurrence of a problem in a washing tub, the outer frame of the washing machine should be opened, pipes for interfering with horizontal movement of the flange, a stovepipe for discharging contaminants, and various sensors, etc. should then be removed. In addition, when the user such as a repairman disassembles dozens of bolts of the flange, the user must disassemble such bolts while avoiding interference of significant peripheral components. In addition, even when the user repairs only one component (e.g., a compressor, etc.), carbon dioxide ($CO_2$) of the entire system should be completely exhausted and the system should be recharged with new carbon dioxide ($CO_2$) after being completely repaired, resulting in consumption of unnecessary resources. The above-described situations may unavoidably cause an increase in equipment maintenance costs.

SUMMARY

The present disclosure is directed to a washing machine in which constituent elements are arranged to facilitate a task for each constituent element. In addition, the present disclosure is directed to a washing machine in which constituent elements are compactly arranged to reduce the overall size of the washing machine.

The present disclosure is also directed to a washing machine capable of reducing environmental pollution by reducing the amount of carbon dioxide ($CO_2$) used for laundry treatment such as washing.

The present disclosure is also directed to a washing machine capable of reducing the size of a pressure vessel designed to use carbon dioxide ($CO_2$) by reducing the amount of the carbon dioxide ($CO_2$) to be used.

The present disclosure is also directed to a washing machine capable of providing the environment in which an operator (or a repairman) can repair the drum that rotates while accommodating laundry.

The present disclosure is also directed to a washing machine capable of reducing the size of a space to be occupied by a motor assembly rotating the drum, thereby reducing the size of an overall space to be occupied by the washing machine.

The present disclosure is also directed to a washing machine capable of stably operating by allowing a washing space including the drum and a motor space including the motor to be kept at the same pressure.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The present disclosure is directed to a washing machine, maintenance of which can be easily performed. Whereas it is difficult to maintain/repair the conventional washing machine because it has a complex system structure and heavy high-pressure components and causes difficult handling of high-pressure gas, the washing machine is designed to be easily maintained/repaired by a user such as a repairman.

The washing machine can allow an electronic panel to rotate by 180° with respect to one axis of a back surface of the washing machine, so that self-inspection of various sensors mounted in the washing machine, program update, signal system inspection, etc. can be performed.

In addition, a compressor, an oil separator, pipes, etc. of the washing machine are modularized in a manner that each component of the washing machine can be independently separated from the system, so that exhausting, vacuuming, and charging of carbon dioxide ($CO_2$) can be performed independently.

According to one aspect of the subject matter described in this application, a washing machine can include a frame defining an appearance of the washing machine, a drum configured to receive laundry, a washing chamber including a first housing defining an opening and a space into which the drum is inserted, a barrier that surrounds the opening and that is coupled to the first housing, and a second housing that surrounds a first surface of the barrier and that is coupled to the first housing, a storage tank configured to receive carbon dioxide to be supplied to the drum, a distillation chamber configured to separate contaminants dissolved in liquid carbon dioxide, an electronic circuit configured to control operations of the washing machine, and a configuration unit including a pipe configured to move the carbon dioxide, a first compressor and a second compressor that are configured to compresses the carbon dioxide discharged after washing is completed in the drum and that are configured to move the compressed carbon dioxide into the storage tank, and an oil separator configured to separate oil from the carbon dioxide compressed in the first compressor and the second compressor. The frame can include a front panel provided on a front surface of the frame, a bottom panel provided on a bottom surface of the frame, and a column coupled to the bottom panel and extending from the bottom panel in a vertical direction.

Implementations according to this aspect can include one or more of the following features. For example, the electronic unit can be rotatably coupled to the column.

In some implementations, the column can includes a front column, and a rear column located opposite to the front panel with respect to the front column. A distance from the front column to the front panel can be less than a distance from the rear column to the front panel, and the rear column can include a first rear column and a second rear column.

In some examples, the electronic unit can be rotatably coupled to the second rear column and can be detachably coupled to the first rear column. In some implementations, the storage tank can be supported by the front column and the rear column. In some implementations, components of the configuration unit can be respectively disposed at an upper side and a lower side of the electronic unit.

In some implementations, the washing machine can further include a door through which the laundry is introduced into the washing chamber and coupled to the front panel. In some implementations, each of the distillation chamber, the storage tank, and the washing chamber can have a cylindrical shape, and a vertical cross-section of each of the distillation chamber, the storage tank, and the washing chamber can have a circular shape.

In some examples, the washing chamber can have a largest radius among the distillation chamber, the storage tank, and the washing chamber. In some examples, the washing chamber can be disposed at a center portion of the front panel with respect to a width direction of the washing machine.

In some implementations, a position of each of the storage tank and the distillation chamber can be biased toward one side with respect to a width direction of the washing machine. In some examples, the position of each of the storage tank and the distillation chamber can be biased in a same direction with respect to the width direction of the washing chamber.

In some implementations, the washing chamber can be disposed between the distillation chamber and the storage tank. In some examples, the distillation chamber can be disposed at a lowest position among the distillation chamber, the storage tank, and the washing chamber.

In some implementations, the storage tank can be disposed at a highest position among the distillation chamber, the storage tank, and the washing chamber. In some implementations, the barrier can be configured to block liquid carbon dioxide injected into a first space provided by the first housing and the barrier from moving into a second space provided by the second housing and the barrier.

In some implementations, at least a portion of the configuration unit can be disposed forward to the electronic unit. In some implementations, the first compressor and the second compressor can be disposed below the electronic unit.

In some implementations, at least a portion of the storage tank can be disposed above the electronic unit. In some implementations, revolutions per minute (RPM) of the first compressor and RPM of the second compressor can be different from each other in a predetermined pressure range of the washing chamber.

DETAILED DESCRIPTION

Figure 1:
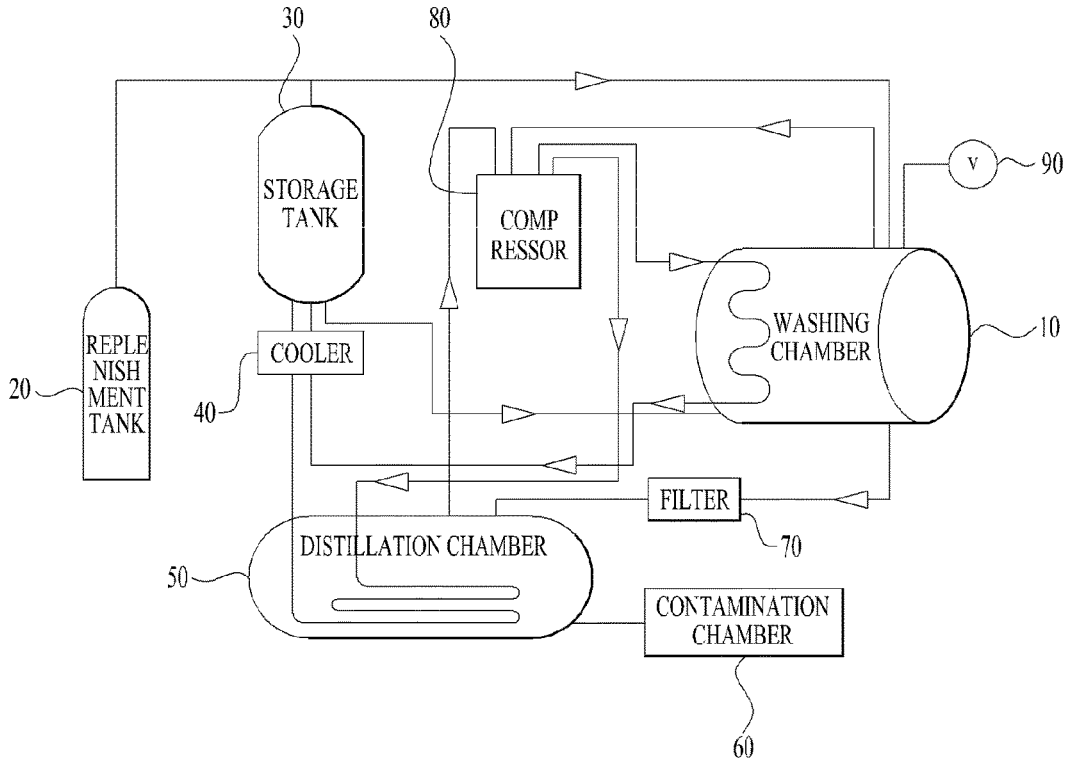
FIG. 1 is a conceptual diagram illustrating an exemplary washing machine.

FIG. 1 is a conceptual diagram illustrating an exemplary washing machine.

Referring to FIG. 1, since the washing machine performs various laundry treatments (such as washing, rinsing, etc. of laundry) using carbon dioxide ($CO_2$), the washing machine can include constituent elements capable of storing or processing such carbon dioxide ($CO_2$).

The washing machine can include a supply unit for supplying carbon dioxide, a washing unit for processing laundry, and a recycling unit for processing used carbon dioxide. The supply unit can include a tank for storing liquid carbon dioxide therein, and a compressor for liquefying gaseous carbon dioxide. The tank may include a supplementary tank and a storage tank. The washing unit may include a washing chamber into which carbon dioxide and laundry can be put together. The recycling unit may include a filter for separating contaminants dissolved in liquid carbon dioxide after completion of the washing procedure, a cooler for liquefying gaseous carbon dioxide, a distillation chamber for separating contaminants dissolved in the liquid carbon dioxide, and a contamination chamber for storing the separated contaminants after distillation.

The supplementary tank 20 can store carbon dioxide to be supplied to the washing chamber 10. In some implementations, the supplementary tank 20 can be a storage tank that can be used when replenishment of carbon dioxide is required, and the supplementary tank 20 may not be installed in the washing machine in a situation where replenishment of such carbon dioxide is not required. The supplementary tank may not be provided in a normal situation, the supplementary tank can be coupled to supplement carbon dioxide as needed, so that replenishment of carbon dioxide can be performed. In some implementations, when such replenishment of carbon dioxide is completed, the supplementary tank can be separated from the washing machine.

The storage tank 30 can supply carbon dioxide to the washing chamber 10, and can store the carbon dioxide recovered through the distillation chamber 50.

The cooler 40 can re-liquefy gaseous carbon dioxide, and can store the liquid carbon dioxide in the storage tank 30.

The distillation chamber 50 can distill liquid carbon dioxide used in the washing chamber 10. The distillation chamber 50 can separate contaminants by vaporizing the carbon dioxide through the distillation process, and can remove the separated contaminants.

The compressor unit 80 can reduce pressure of the inside of the pressurized washing chamber 10 to approximately 1.5 bar.

The contamination chamber 60 can store contaminants filtered through distillation by the distillation chamber 50.

The filter unit 70 can filter out contaminants in the process of discharging liquid carbon dioxide used in the washing chamber 10 into the distillation chamber 50. The filter unit 70 can include a filter having a plurality of fine holes.

Laundry is received in the washing chamber 10, so that washing or rinsing of the laundry can be performed. When a valve of the storage tank 30 connected to the washing chamber 10 opens a flow passage, air pressure in the washing chamber 10 can become similar to air pressure in the storage tank 30. In some implementations, gaseous carbon dioxide can be injected first, and then the inside of the washing chamber 10 can be pressurized through equipment such as a pump, so that the inside of the washing chamber 10 can be filled with liquid carbon dioxide. In a situation in which the inside of the washing chamber 10 is maintained at approximately 45~51 bar and 10~15° C., washing can be performed for 10~15 minutes, and rinsing can be performed for 3~4 minutes. When washing or rinsing is completed, liquid carbon dioxide can be discharged from the washing chamber 10 to the distillation chamber 50.

The valve 90 can remove internal air of the washing chamber 10 before starting the washing procedure, thereby preventing moisture from freezing in the washing chamber 10. Because washing performance is deteriorated when moisture in the washing chamber 10 is frozen, moisture in the washing chamber 10 can be prevented from being frozen.

Figure 2:
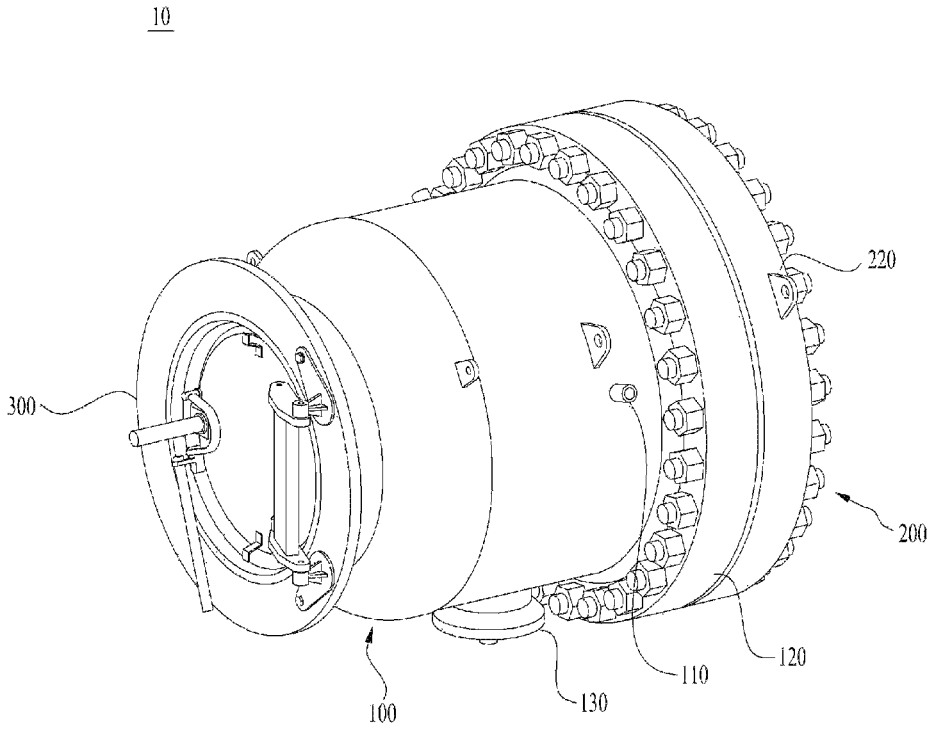
FIG. 2 is a diagram illustrating an appearance of an exemplary washing chamber.
Figure 3:
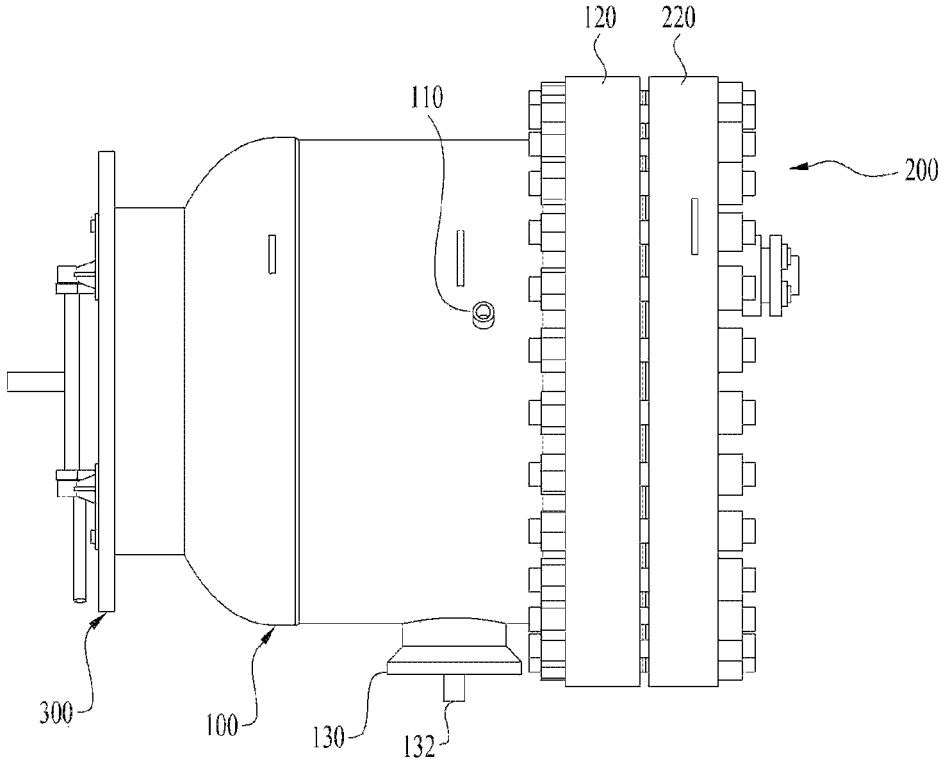
FIG. 3 is a diagram illustrating a front view of the structure shown in FIG. 2.
Figure 4:
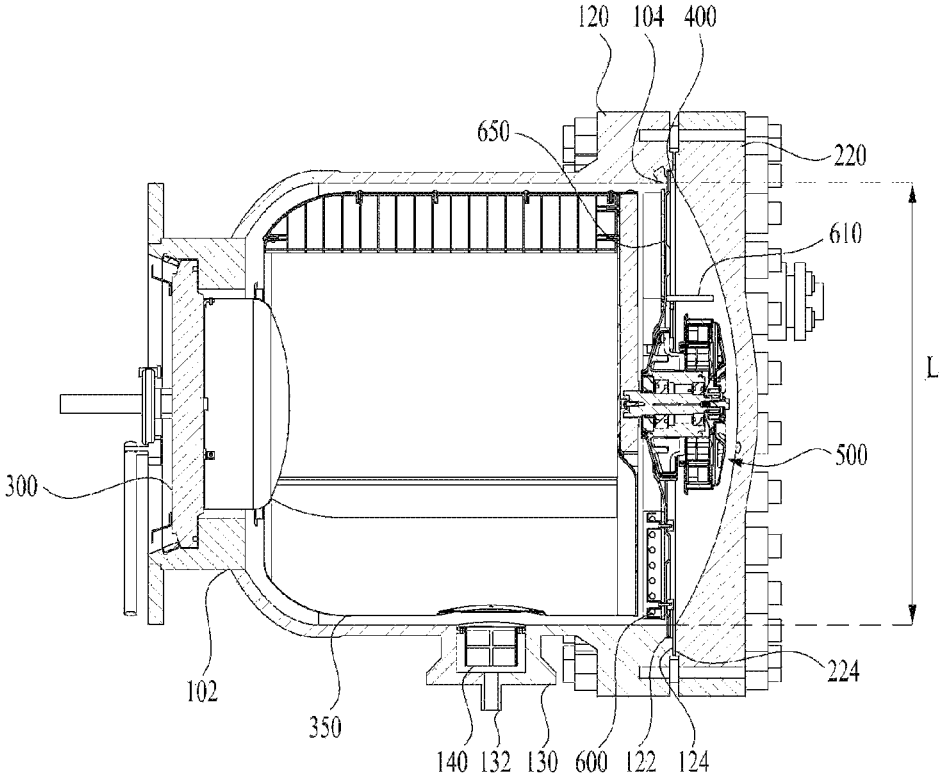
FIG. 4 is a diagram illustrating a cross-sectional view of the structure shown in FIG. 2.

FIG. 2 is a diagram illustrating the appearance of the washing chamber. FIG. 3 is a diagram illustrating a front view of the structure shown in FIG. 2. FIG. 4 is a diagram illustrating a cross-sectional view of the structure shown in FIG. 2.

Referring to FIGS. 2 to 4, the washing chamber 10 can include a door 300, a first housing 100, and a second housing. In some implementations, the washing chamber 10 can refer to a space in which laundry is received and various laundry treatments such as washing, rinsing, etc. of laundry can be performed. In addition, the washing chamber 10 can be provided with a motor assembly that supplies driving force capable of rotating the drum to the washing chamber 10.

The door 300 can be provided at one side of the first housing 100 to open and close the inlet 102 provided in the first housing 100. When the door 300 opens the inlet 102, the user can put laundry to be treated into the first housing 100 or can take the completed laundry out of the first housing 100.

The first housing 100 can define a space in which the drum 350 accommodating laundry is inserted. The drum 350 can be rotatably provided so that liquid carbon dioxide and laundry are mixed together in a state in which laundry is disposed in the drum 350.

The first housing 100 can be provided with an opening 104 in addition to the inlet 102. The opening 104 can be located opposite to the inlet 102, and can have a size larger than a size of the inlet 102.

The first housing 100 can have a cylindrical shape, the inlet 102 having a circular shape can be provided at one side of the first housing 100, and the opening 104 having a circular shape can be provided at the other side of the first housing 100.

The drum 350 can have a cylindrical shape similar to the shape of the inner space of the first housing 100, so that the drum 350 can rotate clockwise or counterclockwise in the first housing 100.

The opening 104 can have a size larger than a size of the cross-section of the drum 350, so that the operator or user can repair the drum by removing the drum 350 through the opening 104. In some implementations, the opening 104 can have a size larger than a maximum cross-section of the drum 350. Therefore, the operator or the user can open the opening 104 to remove the drum 350. It is also possible to install the drum 350 in the first housing 100 through the opening 104.

The opening 104 can have a size larger than a size of the maximum cross-section of the space of the first housing 100. In addition, the opening 104 can be maintained at the same size while extending to the center portion of the first housing 100. Thus, when the operator or the user removes the drum 350 from the first housing 100 or inserts the drum 350 into the first housing 100, a space that is sufficient to not interfere with movement of the drum 350 can be guaranteed.

In some implementations, the user can put laundry into the first housing 100 using the inlet 102, and maintenance or assembly of the drum 350 can be achieved using the opening 104. The inlet 102 and the opening 104 can be located opposite to each other in the first housing 100.

The first housing 100 can be provided with an inlet pipe 110 through which carbon dioxide flows into the first housing 100. The inlet pipe 110 can be a pipe that is exposed to an outside of the first housing 100, so that the pipe through which carbon dioxide flows can be coupled to the constituent elements described in FIG. 1.

The first housing 100 can be provided with the filter fixing part 130 capable of fixing the filter unit 70 to the first housing 100. The filter fixing part 130 can be formed to radially protrude from the cylindrical shape of the first housing 100, resulting in formation of a space in which the filter can be inserted. The filter fixing part 130 can be provided with a discharge pipe 132 through which carbon dioxide filtered through the filter unit 70 can be discharged from the first housing 100. The carbon dioxide used in the first housing 100 can be discharged to an outside of the first housing 100 through the discharge pipe 132.

The first housing 100 can include a first flange 120 provided along the opening 104. The first flange 120 can extend in a radial direction along the outer circumferential surface of the first housing 100 in a similar way to the cylindrical shape of the first housing 100. The first flange 120 can be evenly disposed along the circumference of the first housing 100 in a direction in which the radius of the first housing 100 increases.

The second housing 200 can be coupled to the first housing 100 to form one washing chamber. In some implementations, the washing chamber can provide a space in which laundry treatment is performed and a space in which a motor assembly for providing driving force required to rotate the drum is installed.

The second housing 200 can include a second flange 220 coupled to the first flange 120. The second housing 200 can have a size similar to the cross-section of the first housing 100, and can be disposed at a rear side of the first housing 100.

The second flange 220 can be coupled to the first flange 120 by a plurality of bolts, so that the internal pressure of the washing chamber can be maintained at pressure greater than the external atmospheric pressure in a state in which the second housing 200 is fixed to the first housing 100.

The first fixing part 130 provided in the first housing 100 can be provided with a filter 140 for filtering foreign substances. The filter 140 can include a plurality of small holes blocking foreign substances from entering the first housing, but liquid carbon dioxide can pass through the small holes, so that the liquid carbon dioxide can be discharged to the outside of the first housing 100 through the discharge pipe 132.

In some implementations, a barrier 400 for sealing the opening 104 while coupling to the first housing 100 can be provided. The second housing 200 can seal one surface of the barrier 400.

The drum 350 can be disposed in a space provided on left of the barrier 400 as depicted in FIG. 4, so that laundry and liquid carbon dioxide can be mixed together and laundry treatment such as washing or rising can be performed in the drum 350. In some implementations, the motor assembly 500 can be disposed in a space provided on right of the barrier 400 as depicted in FIG. 4, thereby providing driving force capable of rotating the drum 350. In some implementations, a portion of the motor assembly 500 can be coupled to the drum 350 after passing through the barrier 400.

The barrier 400 can have a size larger than a size of the opening 104, and can be disposed to be in contact with the opening 104, thereby sealing the opening 104. The barrier 400 and the opening 104 can be formed to have a substantially circular shape similar to the shape of the first housing 100, and the diameter L of the opening 104 can be smaller than the diameter of the barrier 400. The diameter L of the opening 104 can be greater than the diameter of the drum 350. Therefore, the cross-section of the drum 350 can be formed to have the smallest size among the drum 350, the opening 104, and the barrier 400, the cross-section of the opening 104 can be formed to have a medium size among the drum 350, the opening 104, and the barrier 400, and the barrier 400 can be formed to have the largest size among the drum 350, the opening 104, and the barrier 400.

The barrier 400 can be arranged to have a plurality of steps, thereby guaranteeing sufficient strength.

The first flange 120 can be provided with a seating groove 122 coupled to the barrier 400 so that the seating groove 122 can be formed along the opening 104. For example, the seating groove 122 can be provided at a portion extending in a radial direction from the opening 104. The seating groove 122 can be recessed by a thickness of the barrier 400 so that the first flange 120 and the second flange 220 are provided to contact each other. The seating groove 122 can be formed to have the same shape as the outer circumferential surface of the barrier 400. Thus, when the barrier 400 is seated in the seating groove 122, the surface of the first flange 120 can become flat.

The first flange 120 can include the first seating surface 124 extending farther in a radial direction than the circumference of the seating groove 122, and the second flange 220 can include a second seating surface 224 coupled to the first seating surface 124 in surface contact with the first seating surface 124. The first seating surface 124 and the second seating surface 224 can be disposed to be in contact with each other, so that carbon dioxide injected into the inner space of the first housing 100 can be blocked from being disposed outside the first housing 100. The first seating surface 124 and the second seating surface 224 can be in surface contact with each other while being disposed at the outer circumferential surfaces of the first housing 100 and the second housing 200, and can provide a coupling surface where two housings can be bolted to each other.

A heat exchanger 600 in which refrigerant flows can be disposed at the barrier 400. The heat exchanger 600 can be disposed in a space provided by the first housing 100 and the barrier 400. The heat exchanger 600 can be configured to change a temperature of the space provided by the first housing 100. The temperature of the space provided by the first housing 100 can be reduced so that humidity of the inner space of the first housing 100 can be lowered.

A heat insulation member (i.e., an insulation member) 650 can be disposed between the heat exchanger 600 and the barrier 400. The heat insulation member 650 can block the temperature of the heat exchanger 600 from being directly transferred to the barrier 400. The heat insulation member 650 can allow the barrier 400 to be less affected by temperature change of the heat exchanger 600. The heat insulation member 650 can be formed similar to the shape of the heat exchanger, thereby covering the entire surface of the heat exchanger 600.

Figure 5:
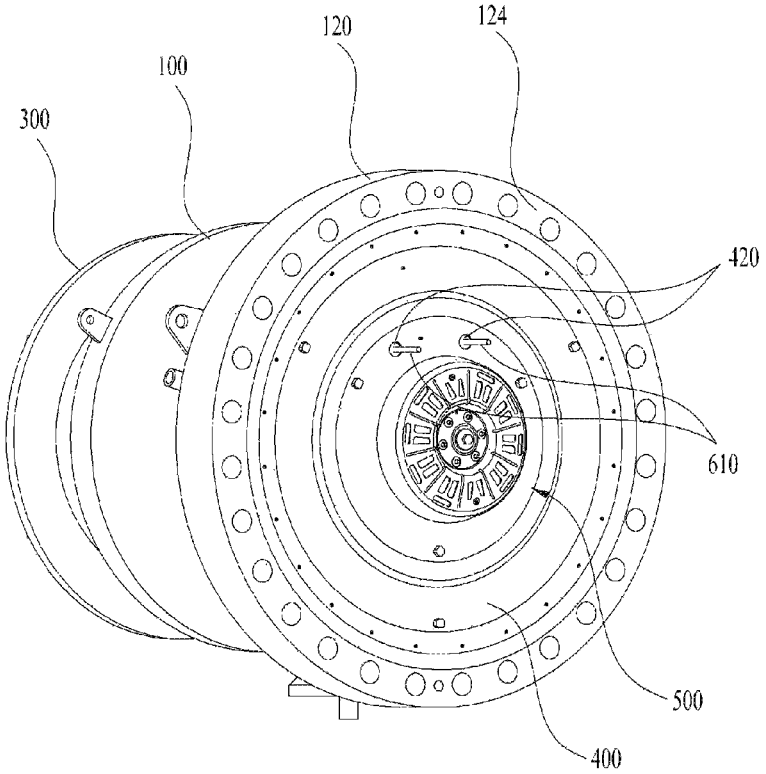
FIG. 5 is a diagram illustrating a second housing separated from the structure shown in FIG. 2.
Figure 6:
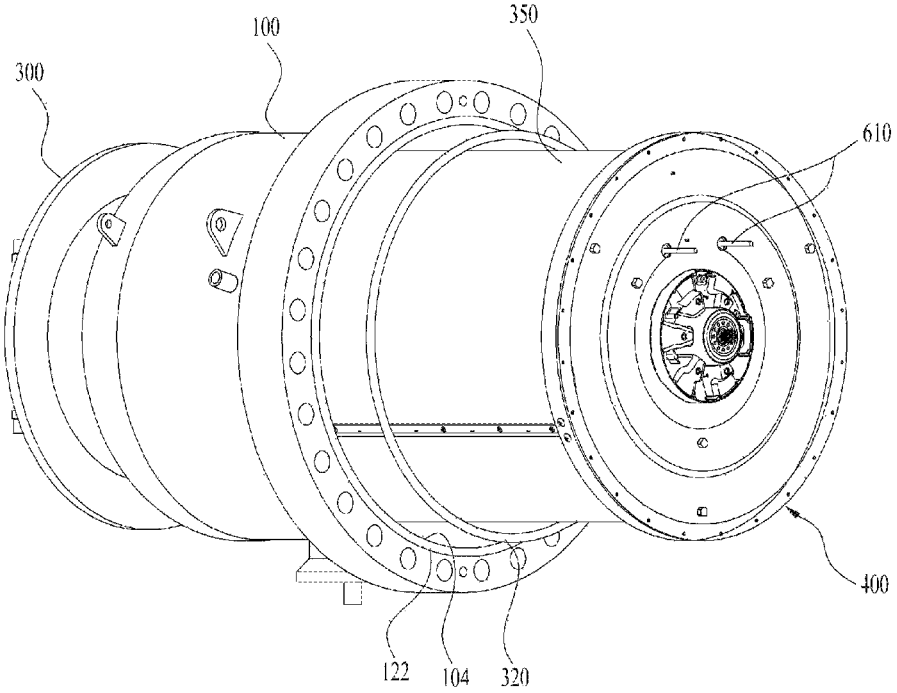
FIG. 6 is a diagram illustrating components of an exemplary drum shown in FIG. 5 detached rearward.

FIG. 5 is a diagram illustrating the second housing 200 separated from the structure shown in FIG. 2. FIG. 6 is a diagram illustrating components of the drum shown in FIG. 5 detached rearward.

Referring to FIGS. 5 and 6, when the second housing 200 is separated from the first housing 100, the barrier 400 can be exposed outside. Since the barrier 400 is coupled to the seating groove of the first housing 100, the inner space of the first housing is not exposed outside even when the second housing 200 is separated from the first housing 100. The barrier 400 can be coupled to the second housing 200 by a plurality of bolts or the like.

A motor assembly 500 can be coupled to the center portion of the barrier 400, and a second through-hole 420 can be defined at an upper side of the motor assembly 500. A refrigerant pipe 610 for circulating a refrigerant in the heat exchanger 600 can pass through the second through-hole 420.

When the barrier 400 is separated from the first housing 100, the opening 104 can be exposed outside. In some implementations, the drum 350 can be withdrawn to the outside through the opening 104. As the opening 104 is larger in size than the drum 350, maintenance of the drum 350 can be performed through the opening 104.

A gasket 320 can be disposed between the barrier 400 and the seating groove 122. In some implementations, when the barrier 400 is coupled to the first housing 100, carbon dioxide can be blocked from leaking between the barrier 400 and the first housing 100. When the barrier 400 is seated in the seating groove 122, the barrier 400 can be coupled to the first housing 100 by the plurality of bolts while compressing the gasket 320. A plurality of coupling holes through which the barrier 400 is coupled to the first housing 100 can be evenly disposed along the outer circumferential surface of the barrier 400.

Figure 7:
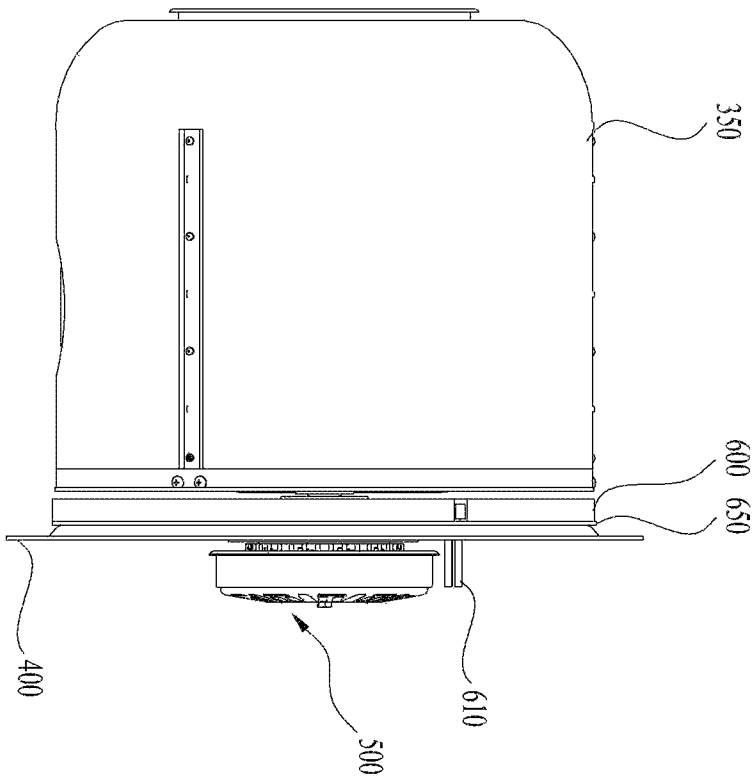
FIG. 7 is a diagram illustrating the exemplary drum and some constituent elements included in the exemplary drum.
Figure 8:
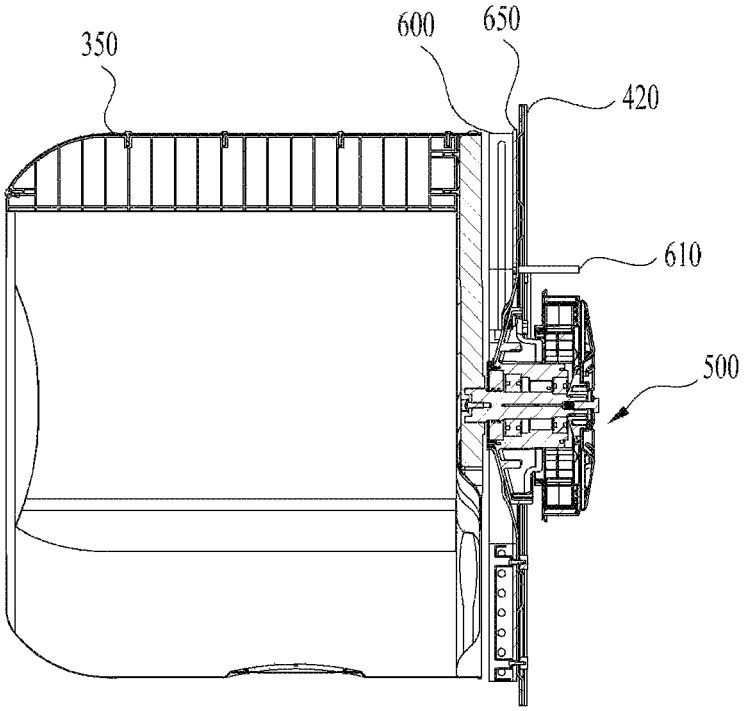
FIG. 8 is a diagram illustrating a cross-sectional view of the structure shown in FIG. 7.
Figure 9:
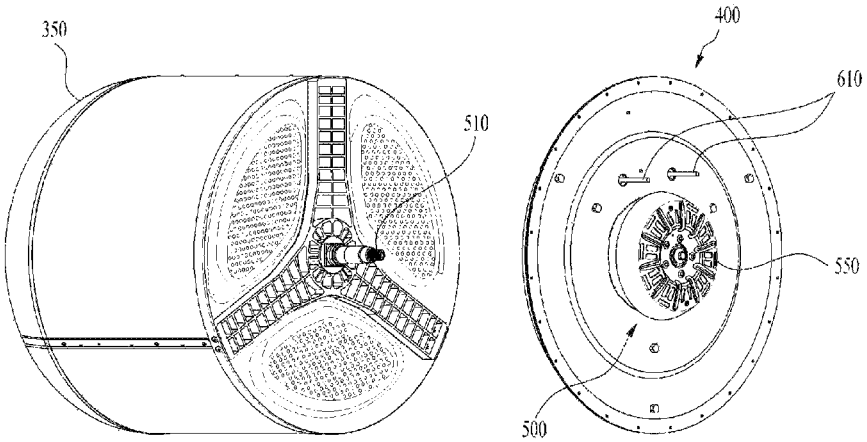
FIG. 9 is a diagram illustrating an exploded perspective view of the structure shown in FIG. 7.
Figure 10:
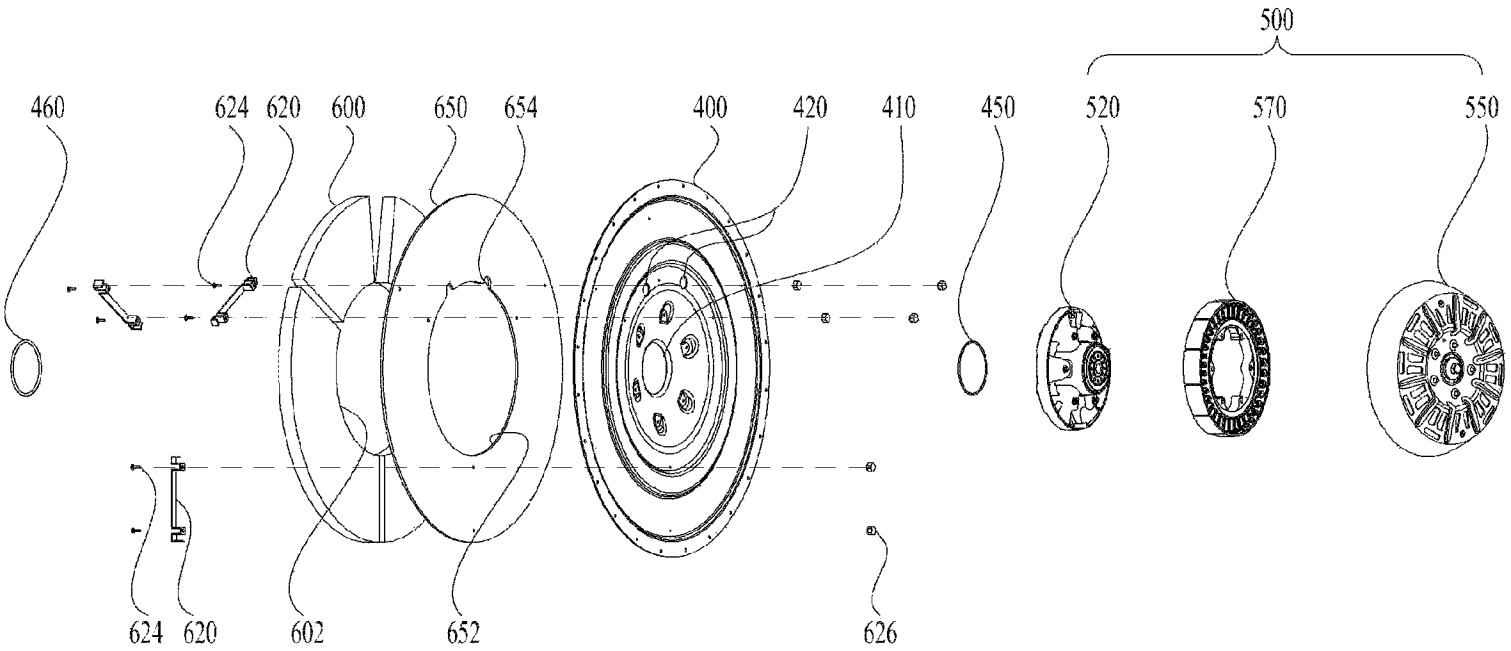
FIG. 10 is a diagram illustrating an exploded perspective view of the main constituent elements of the structure shown in FIG. 7.

FIG. 7 is a diagram illustrating a drum and some constituent elements of the drum. FIG. 8 is a diagram illustrating a cross-sectional view of the structure shown in FIG. 7. FIG. 9 is a diagram illustrating an exploded perspective view of the structure shown in FIG. 7. FIG. 10 is a diagram illustrating an exploded perspective view of the main constituent elements of the structure shown in FIG. 7.

As depicted in FIGS. 7 and 8, the first housing 100 can be removed so that the drum 350 is exposed outside. The drum 350 can have a cylindrical shape such that laundry received by the drum 350 through the inlet 102 is movable into the drum 350.

The drum 350, the heat exchanger 600, and the heat insulation member 650 can be disposed in a left side of the barrier 400 as depicted in FIGS. 7 and 8. The motor assembly 500 can be disposed in a right side of the barrier 400 as depicted in FIGS. 7 and 8.

FIG. 9 is a diagram illustrating an exploded perspective view of the drum 350 and the barrier 400 separated from each other. Referring to FIG. 9, the rotary shaft 510 of the motor assembly 500 can be coupled to the drum 350 at the rear of the drum 350. Therefore, when the rotary shaft 510 rotates, the drum 350 can also be rotated thereby. In addition, when the rotational direction of the rotary shaft 510 is changed, the rotational direction of the drum 350 can also be changed.

Since the motor assembly 500 is coupled to the barrier 400, the driving force required to rotate the drum 350 is not transmitted to the drum 350 through a separate belt or the like. As a result, rotational force of the motor can be directly transmitted to the drum 350, so that loss of force or occurrence of noise can be reduced.

FIG. 10 is a diagram illustrating an exploded perspective view of constituent elements installed at the barrier shown in FIG. 9.

Referring to FIG. 10, the heat exchanger 600 can be formed in a doughnut shape similar to the shape of the opening 104. A circular through-hole 602 can be defined at the center of the heat exchanger 600 so that the rotary shaft 510 of the motor can pass through the through-hole 602.

The heat insulation member 650 can have a shape corresponding to the heat exchanger 600, and can block the temperature change generated in the heat exchanger 600 from being transferred to the barrier 400. The heat insulation member 650 can be made of a material having low thermal conductivity, and can be disposed between the heat exchanger 600 and the barrier 400. A circular through-hole 652 can be defined at the center of the heat insulation member 650 so that the rotary shaft 510 of the motor can pass through the through-hole 652.

The circular shape of the through-hole 602 of the heat exchanger 600 can be similar in size to the circular shape of the through-hole 652 of the heat insulation member 650. In some implementations, the through-hole 652 can be formed with a through-groove 654 through which the refrigerant pipe 610 for supplying refrigerant to the heat exchanger 600 can pass.

The heat exchanger 600 can include a bracket 620 coupled to the barrier 400. The bracket 620 can be fixed to the barrier 400 by both a bolt 624 penetrating the barrier 400 and a cap nut 626 coupled to the bolt 624.

The bracket 620 can be formed in a three-dimensionally stepped shape such that the bracket 620 is disposed at a surface where the heat exchanger 600 has a thin thickness. The bolt 624 can be disposed at the stepped groove portion, and can be coupled to the cap nut 626.

The plurality of brackets 620 can be provided, so that the heat exchanger 600 and the heat insulation member 650 can be coupled to the barrier 400 at a plurality of points. Although FIG. 10 illustrates three brackets 620 for convenience of description, a greater number of brackets or a less number of brackets compared to the three brackets can also be used as necessary. The plurality of brackets can be evenly disposed at various positions of the heat exchanger 600, so that the heat exchanger 600 can be more stably fixed.

The motor assembly 500 can be coupled to the barrier 400. The motor assembly 500 can include a stator 570, a rotor 550, and a bearing housing 520. The bearing housing 520 can include the rotary shaft 510. One end of the rotary shaft 510 can be coupled to the rotor 550, and the other end of the rotary shaft 510 can be coupled to the drum 350. Therefore, as the rotor 550 rotates around the stator 570, the rotary shaft 510 is also rotated.

The stator 570 is fixed to a bearing housing 520, thereby providing the environment in which the rotor 550 can rotate.

When the bearing housing 520 is coupled to the barrier 400, an O-ring 450 can be disposed between the bearing housing 520 and the barrier 400, so that liquid carbon dioxide injected into the first housing 100 is blocked from flowing into a gap between the barrier 400 and the bearing housing 520. In some implementations, an O-ring cover 460 can be disposed to improve the coupling force of the O-ring 450. The O-ring cover 460 can be formed similar in shape to the O-ring 450. The O-ring cover 460 can reduce the size of one surface where the O-ring 450 is exposed to one side of the barrier 400, thereby more strongly sealing the gap.

Figure 11A:
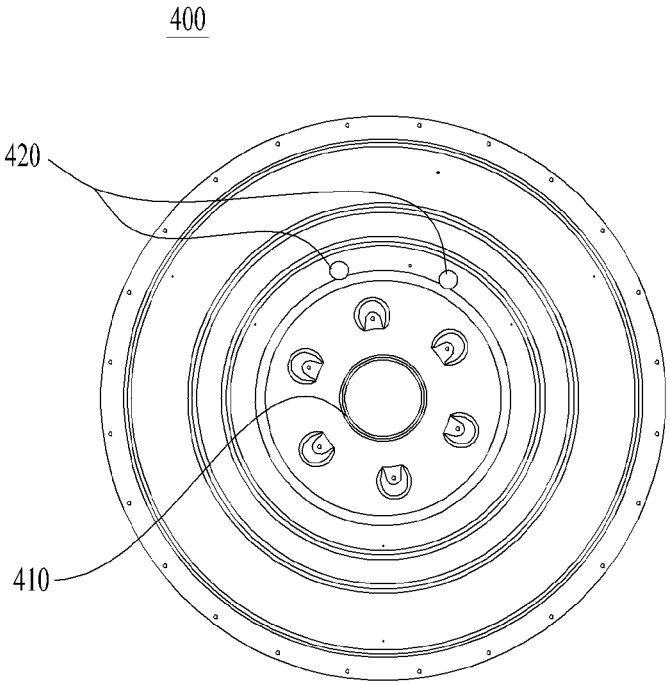
FIGS. 11A and 11B are diagrams illustrating a barrier.
Figure 11B:
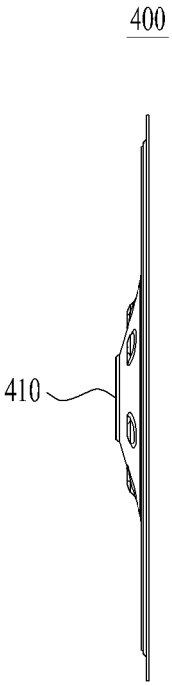

FIGS. 11A and 11B are diagrams illustrating the barrier 400. FIG. 11A is a diagram illustrating a front view of the barrier 400, and FIG. 11B is a diagram illustrating a side cross-sectional view of the center portion of the barrier 400.

As depicted in the side cross-sectional view of the barrier 400, since the barrier 400 includes a plurality of step differences, the barrier 400 can provide sufficient strength by which the heat exchanger 600 can be fixed to one side of the barrier 400 and the motor assembly 500 can be fixed to the other side of the barrier 400.

A first through-hole 410 through which the rotary shaft 510 of the motor passes can be defined at the center of the barrier 400. The first through-hole 410 can have a circular shape, so that no contact occurs at the rotary shaft 510 passing through the first through-hole 410.

The barrier 400 can include a second through-hole 420 through which gaseous carbon dioxide moves. The second through-hole 420 can be disposed at a higher position than the first through-hole 410. The second through-hole 420 can be disposed to allow the refrigerant pipe 610 to pass therethrough. The second through-hole 420 can have a size larger than a size of the first through-hole 410.

In some implementations, the second through-hole 420 can be implemented as two separate holes. The second through-holes 420 can be disposed symmetrical to each other with respect to the center point of the barrier 400.

The barrier 400 can be a single component capable of being separated from the first housing 100 or the second housing 200, and can provide a coupling structure between the heat exchanger 600 and the motor assembly 500.

In addition, when the barrier 400 is separated from the first housing 100, the environment in which the user or operator can separate the drum 350 from the first housing 100 can be provided.

The barrier 400 can be formed to have a plurality of step differences in a forward or backward direction, and can sufficiently increase the strength. In addition or alternatively, the barrier 400 can be formed to have a curved surface within some sections, so that the barrier 400 can be formed to withstand force generated in various directions. The outermost portion of the barrier 400 can be coupled to the seating groove 122 of the first housing 100.

Referring to the direction from the outermost part of the barrier 400 to the center part of the barrier 400 as depicted in FIG. 11B, the barrier 400 can be formed to have step differences in various directions (e.g., the barrier first protrudes to the left side, protrudes to the right side, and again protrudes to the left side) by various lengths, thereby increasing strength.

Figure 12:
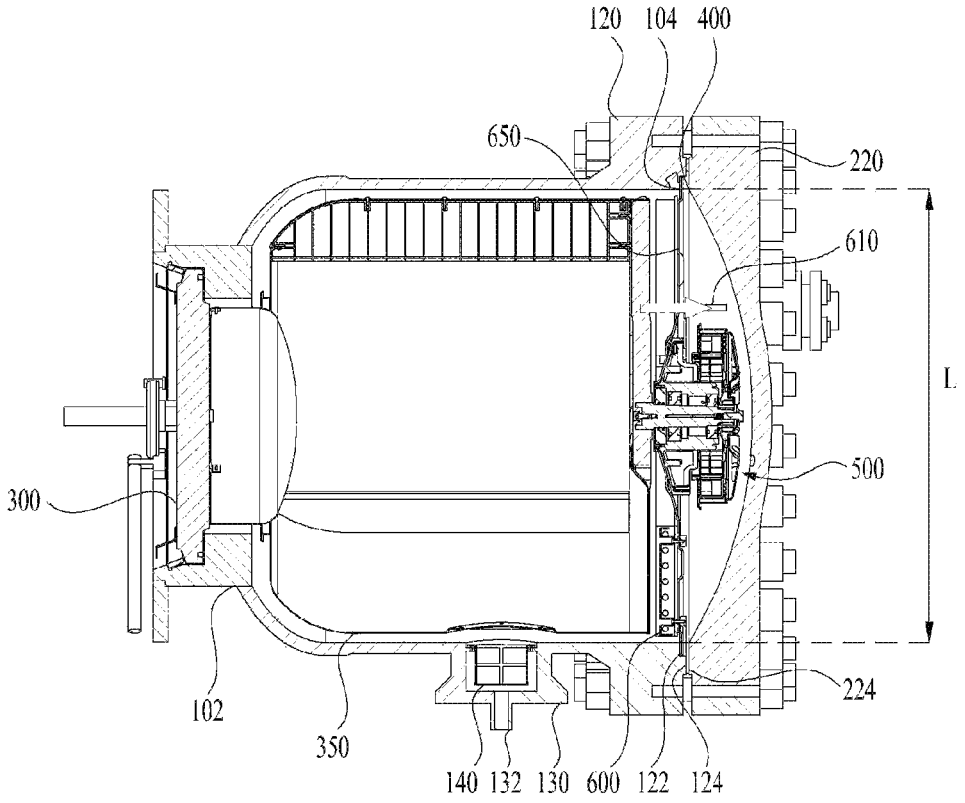
FIG. 12 is a diagram illustrating a function of a second through-hole.

FIG. 12 is a diagram illustrating a function of the second through-hole.

Referring to FIG. 12, carbon dioxide may be injected into the drum 350 to perform washing of laundry. In some implementations, the carbon dioxide can be a mixture of liquid carbon dioxide and gaseous carbon dioxide. Since the liquid carbon dioxide is heavier than the gaseous carbon dioxide, the liquid carbon dioxide may be located below the gaseous carbon dioxide, and the gaseous carbon dioxide may be present in the empty space located over the liquid carbon dioxide.

By rotation of the drum 350, laundry disposed in the drum 350 can be mixed with liquid carbon dioxide.

The barrier 400 can block liquid carbon dioxide injected into the space provided by both the first housing 100 and the barrier 400 from flowing into the other space defined by both the second housing 200 and the barrier 400. For example, since the barrier 400 seals the opening 104, liquid carbon dioxide cannot move to the opposite side of the barrier 400.

During laundry treatment such as washing, the space provided by the first housing 100 and the barrier 400 is separated from the space provided by the second housing 200 and the barrier 400. In some implementations, the space provided by the first housing 100 and the barrier 400 may be filled with liquid carbon dioxide and gaseous carbon dioxide at a higher pressure than atmospheric pressure. Therefore, in order to stably maintain the pressure of the washing chamber, only gaseous carbon dioxide rather than liquid carbon dioxide may move into the space formed by the second housing 200 and the barrier 400, resulting in implementation of pressure equilibrium.

In some implementations, gaseous carbon dioxide may pass through the barrier 400 through the second through-hole 420 provided at the barrier 400. However, since the second through-hole 420 is located higher in height than the liquid carbon dioxide, the gaseous carbon dioxide cannot move through the second through-hole 420.

Typically, the amount of liquid carbon dioxide used in washing or rising of laundry may not exceed half of the total capacity of the drum 350. For example, the amount of liquid carbon dioxide does not exceed the height of the rotary shaft 510 coupled to the drum 350.

Therefore, if the second through-hole 420 is located higher than the rotary shaft 510, gaseous carbon dioxide may not move through the second through-hole 420. However, since the space provided by the first housing 100 and the barrier 400 is filled with gaseous carbon dioxide, the gaseous carbon dioxide can freely flow into the space provided by the second housing 200 and the barrier 400, resulting in implementation of pressure equilibrium.

For example, during laundry treatment such as washing or rinsing, gaseous carbon dioxide and liquid carbon dioxide may be mixed with each other in the space partitioned by the first housing 100 and the barrier 400. On the other hand, whereas liquid carbon dioxide is not present in the space partitioned by the second housing 200 and the barrier 400, only gaseous carbon dioxide may be present in the space partitioned by the second housing 200 and the barrier 400. Since two spaces are in a pressure equilibrium state therebetween, liquid carbon dioxide need not be present in the space provided by the second housing 200 and the barrier 400, and the amount of used liquid carbon dioxide may be reduced in the space provided by the second housing 200 and the barrier 400. Therefore, the total amount of carbon dioxide to be used in washing or rinsing of laundry can be reduced, so that the amount of carbon dioxide to be used can be greatly reduced compared to the conventional washing machine. As a result, the amount of carbon dioxide to be reprocessed after use can also be reduced. As described above, the amount of carbon dioxide to be used can be reduced, so that a storage capacity of the tank configured to store carbon dioxide and the overall size of the washing machine configured to use carbon dioxide can also be reduced. In addition, since the amount of carbon dioxide to be reprocessed after use is reduced, the time required to perform washing or rinsing can also be reduced.

Figure 13:
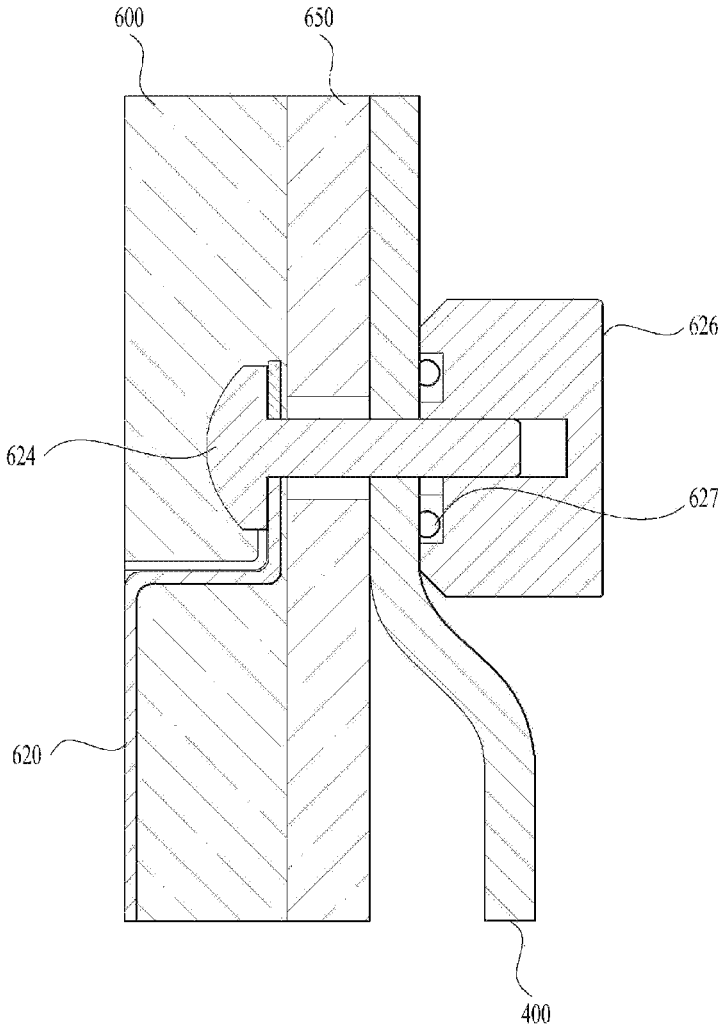
FIG. 13 is a diagram illustrating a structure in which a heat exchanger is coupled to a barrier.

FIG. 13 is a diagram illustrating a structure in which the heat exchanger is coupled to the barrier.

FIG. 13 is a diagram illustrating a cross-sectional view of a portion in which the bracket 620 is in contact with the heat exchanger 600.

The bracket 620 can have a stepped shape, and the stepped portion is in contact with the heat exchanger 600, so that the heat exchanger 600 can be fixed. The protruding portion can be disposed to contact the heat insulation member 650.

The bolt 624 can be fixed to the protruding portion, and the bolt 624 can pass through the heat insulation member 650 and the barrier 400. A cap nut 626 can be provided at the opposite side of the bolt 624, so that the bolt 624 can be fixed by the cap nut 626. The cap nut 626 can be in contact with the plurality of points of the barrier 400, so that the fixing force at the barrier 400 can be guaranteed.

The cap nut 626 can have a rectangular parallelepiped shape, and a coupling groove can be provided at a portion contacting the barrier 400. A sealing 627 can be disposed in the coupling groove to seal a gap when the cap nut 626 is coupled to the barrier 400. For example, when the cap nut 626 is coupled to the bolt 624, the sealing 627 is pressed so that the bolt 624 can be fixed while being strongly pressurized by the cap nut 626. In some implementations, the barrier 400 can also be pressed together, a hole through which the bolt 624 passes can be sealed.

The bracket 620 can be implemented as a plurality of brackets, so that the heat exchanger 600 can be fixed at various positions. Although the shape of the brackets 620 may be changed when viewed from each direction, the same method for coupling the bracket 620 by the bolt and the cap nut can be applied to the brackets 620.

Figure 14:
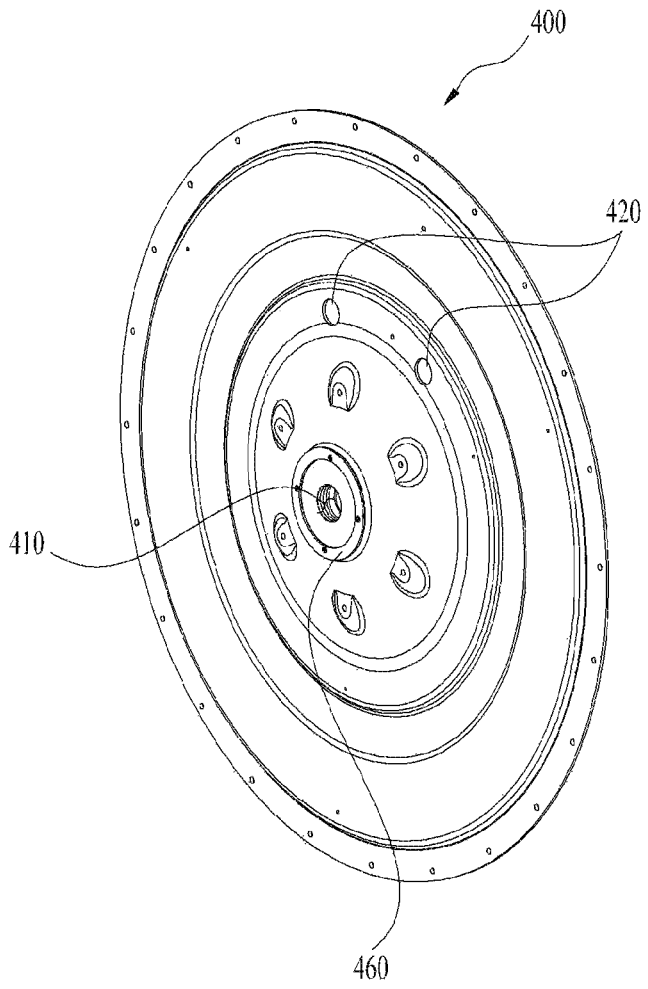
FIG. 14 is a diagram illustrating an O-ring and an O-ring cover mounted to the barrier.
Figure 15:
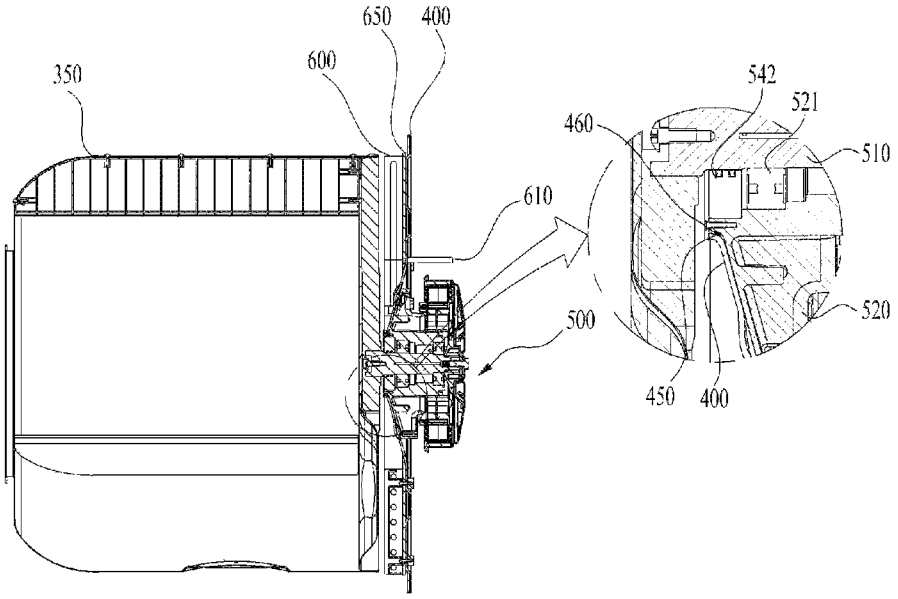
FIG. 15 is a diagram illustrating an exemplary state in which the structure of FIG. 14 is coupled to other constituent elements.

FIG. 14 is a diagram illustrating the O-ring and the O-ring cover mounted to the barrier. FIG. 15 is a diagram illustrating an exemplary state in which the structure of FIG. 14 is coupled to other constituent elements.

The O-ring 450 can be disposed at a portion where the bearing housing 520 is coupled to the barrier 400. The O-ring 450 can block liquid carbon dioxide from flowing into the space opposite to the barrier 400.

For example, since the rotary shaft 510 is disposed to pass through the first through-hole 410 of the barrier 400, the gap may exist in the first through-hole 410. Since the rotary shaft 510 rotates, the rotary shaft 510 may be spaced apart from the through-hole 410 by a predetermined gap, and this predetermined gap cannot be sealed. Therefore, the bearing housing 520 is coupled to the barrier 400, and the gap between the bearing housing 520 and the barrier 400 is sealed by the O-ring 450, so that carbon dioxide can be blocked from moving through the gap sealed by the O-ring 450.

The O-ring 450 can be coupled to the O-ring cover 460 blocking separation of the O-ring 450. The O-ring cover 460 can surround one surface of the O-ring 450, so that the O-ring cover 460 can block the O-ring 450 from being exposed to a space provided by the first housing 100. Therefore, the O-ring cover 460 can block the O-ring 450 from being separated by back pressure.

Figure 16:
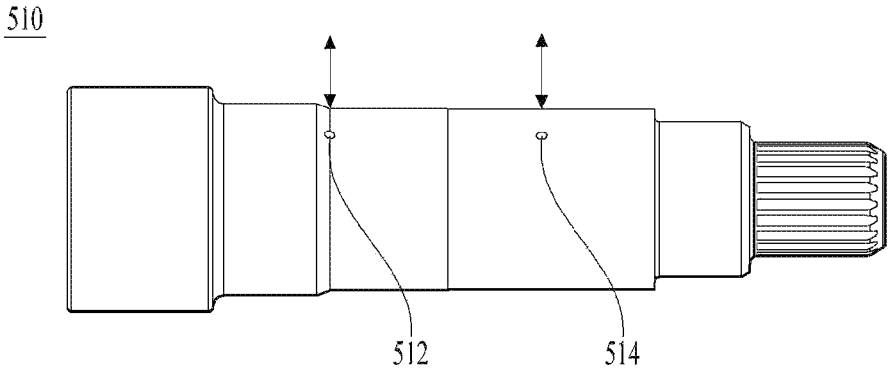
FIG. 16 is a diagram illustrating a rotary shaft.
Figure 17:
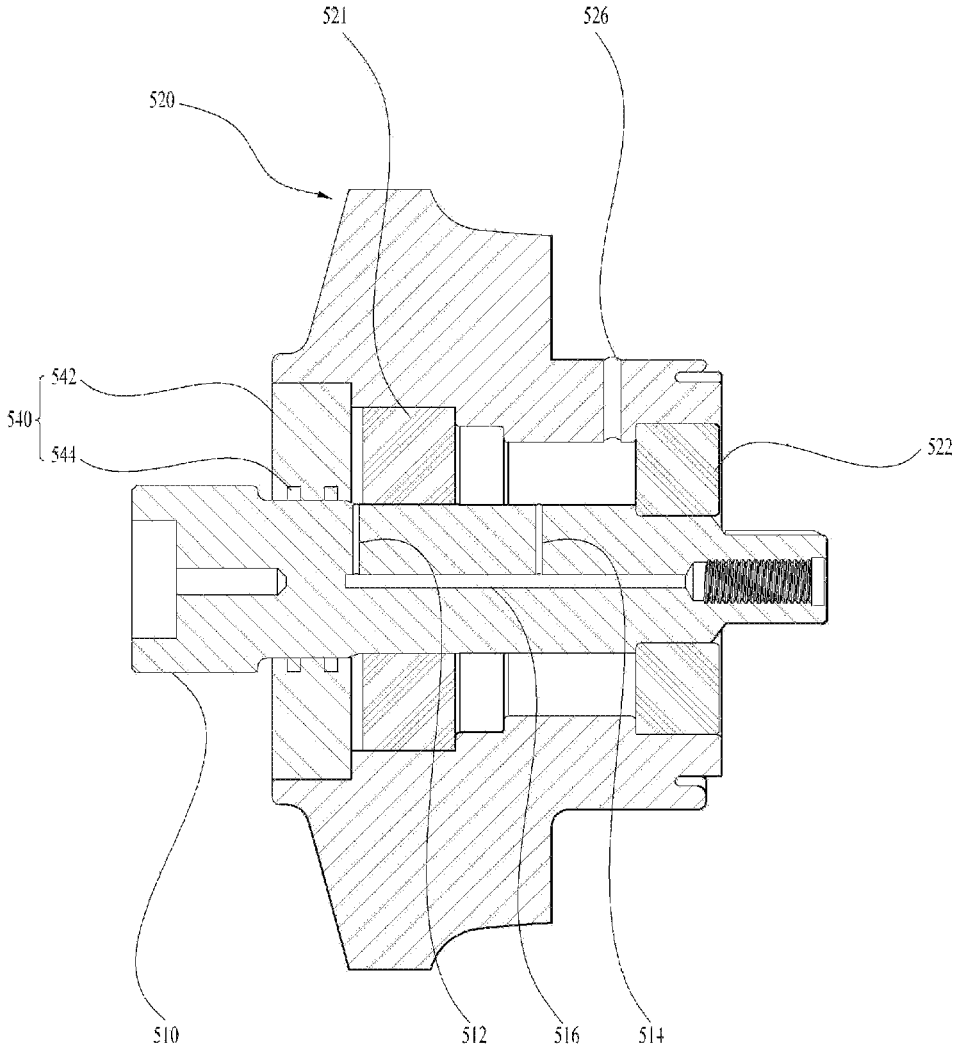
FIG. 17 is a diagram illustrating an exemplary state in which the rotary shaft of FIG. 16 is coupled to other constituent elements.

FIG. 16 is a diagram illustrating the rotary shaft. FIG. 17 is a diagram illustrating an exemplary state in which the rotary shaft of FIG. 16 is coupled to other constituent elements.

A rotary shaft 510 having one side coupled to the drum 350 and the other side coupled to the rotor 550 can be provided at the center of the bearing housing 520. The rotary shaft 510 can be disposed to pass through the center of the bearing housing 520.

The rotary shaft 510 can be supported by the bearing housing 520 through the first bearing 521 and the second bearing 522. The rotary shaft 510 can be supported to be rotatable by the two bearings. In some implementations, the two bearings may be implemented as various shapes of bearings as long as they are rotatably supported components.

In some implementations, the first bearing 521 and the second bearing 522 may have different sizes, so that the first bearing 521 and the second bearing 522 can stably support the rotary shaft 510. In some implementations, the shape of the rotary shaft 510 corresponding to a portion supported by the first bearing 521 may be formed differently from the shape of the rotary shaft 510 corresponding to a portion supported by the second bearing 522 as needed.

A sealing portion 540 can be provided at one side of the first bearing 521. The sealing portion 540 can be disposed along the circumferential surface of the rotary shaft 510. The sealing portion 540 can be disposed to be exposed to the space provided by the first housing 100 and the barrier 400, so that carbon dioxide can be blocked from moving through a gap between the rotary shaft 510 and the bearing housing 520. Specifically, the sealing portion 540 can block liquid carbon dioxide from moving into the space opposite to the barrier 400.

The sealing portion 540 can include a shaft-seal housing 542 that is disposed between the rotary shaft 510 and a hole through which the rotary shaft 510 passes, so that the shaft-seal housing 542 can seal a gap between the rotary shaft 510 and the hole. A shaft seal 544 can be disposed at a portion where the shaft-seal housing 542 and the rotary shaft 510 meet each other, thereby improving sealing force. The shaft seal 544 can be disposed to surround the circumferential surface of the rotary shaft 510.

The bearing housing 520 can define a communication hole 526 through which inflow or outflow of external air is provided. The communication hole 526 of the bearing housing 520 can be exposed to the space partitioned by the second housing 200 and the barrier 400.

The rotary shaft 510 can be provided with a first flow passage 512 and a second flow passage 514 spaced apart from each other such that inflow or outflow of air is provided through the first flow passage 512 and the second flow passage 514. In some implementations, the first flow passage 512 and the second flow passage 514 can be provided in a radial direction from the center of the rotary shaft 510.

Air in the space partitioned by the second housing 200 and the barrier 400 may flow into the rotary shaft 510 through the first flow passage 512 and the second flow passage 514.

For example, a connection flow passage 516 for connecting the first flow passage 512 to the second flow passage 514 can be provided. The connection flow passage 516 can be disposed at the center of rotation of the rotary shaft 510, and can be vertically connected to each of the first flow passage 512 and the second flow passage 514.

If the connection flow passage 516 does not exist, each of the first flow passage 512 and the second flow passage 514 is perforated on the outer surface of the rotary shaft 510, but the opposite side of each of the first flow passage 512 and the second flow passage 514 is closed. Therefore, it is difficult for air to substantially flow into the first flow passage 512 or the second flow passage 514. To this end, the connection flow passage 516 for interconnecting two flow passages may be formed. Thus, when the internal pressure of the rotary shaft 510 is changed, air can more easily flow into the first flow passage 512, the second flow passage 514, and the connection flow passage 516, so that pressure of the rotary shaft 510 can be maintained in the same manner as the external pressure change.

The rotary shaft 510 can rotate in a state in which one side of the rotary shaft 510 is fixed to the drum 350 and the other side of the rotary shaft 510 is fixed to the rotor 550. Therefore, noise or vibration may occur in the rotary shaft 510. If the rotary shaft 510 rotates at a place where there occurs a pressure deviation, noise or vibration may unavoidably increase. Therefore, the rotary shaft 510 can include a communication hole 526 through which air can flow into the bearing housing 520. The bearing housing 520 is a relatively large component and has a space for allowing air to enter and circulate therein, so that air can be introduced without distinction between the air inlet and the air outlet. In some implementations, the rotary shaft 510 can be made of a material having high rigidity, but the strength of the rotary shaft 510 is reduced so that it is difficult to secure the space in which air can easily flow, thereby increasing the size of the air passage. Therefore, the plurality of flow passages can be coupled to each other, resulting in formation of a path through which the introduced air can be discharged through the opposite flow passage.

In some implementations, the washing chamber 10 can be coupled to the first housing 100 and the second housing 200, resulting in formation of a sealed space. In some implementations, the sealed space can be divided into two spaces by the barrier 400. Based on the barrier 400, one space may be a space for laundry treatment, and the other space may be a space for installation of the motor or the like.

Figure 18:
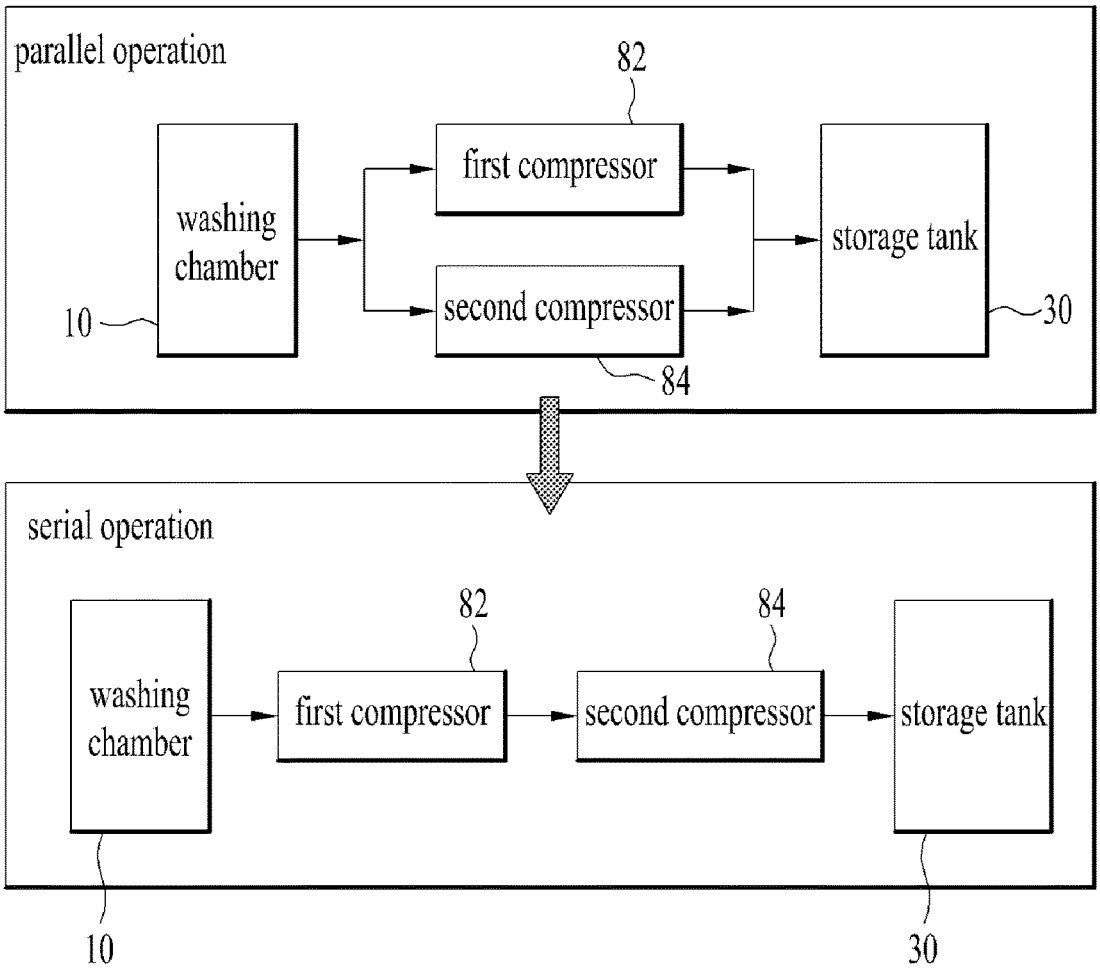
FIG. 18 is a diagram illustrating a concept of operations of the washing machine.

FIG. 18 is a diagram illustrating a concept of operations of the washing machine.

Referring to FIG. 18, the compressor unit 80 can include two compressors. The compressor unit 80 can include a first compressor 82 and a second compressor 84, each of which compresses carbon dioxide ($CO_2$) discharged after completion of washing in the drum so that the compressed carbon dioxide ($CO_2$) flows into the storage tank 30. The carbon dioxide ($CO_2$) generated after completion of washing in the washing chamber 10 can be guided to the storage tank 30 by the first compressor 82 and the second compressor 84. In an initial stage, a parallel operation in which carbon dioxide ($CO_2$) is compressed by each of the two compressors is performed. In the latter stage, a serial operation in which two compressors compress carbon dioxide ($CO_2$) through multistage compression so that carbon dioxide ($CO_2$) flows into the storage tank 30 is performed.

When a current pressure of the washing tub reaches a preset pressure during a recovery mode operation of the washing tub of the washing machine in which a reciprocating compressor (based on the piston~cylinder volume compression scheme) compressor is used in two stages, after a parallel operation mode transitions to a serial operation mode by switching of the system-side valve, the RPM (revolutions per minute) of each compressor is adjusted after lapse of a predetermined time ($\Delta t$), so that a serial operation mode of a high-pressure ratio region can be implemented.

However, when the system is operated as described above, there are three kinds of vulnerabilities. In the first vulnerability, a (low-speed+serial) operation is performed for a preset time ($\Delta t$) so that there occurs a section where the recovery flow rate decreases, resulting in an increase in the total washing time. In the second vulnerability, a mechanical behavior (=RPM) of the compressor is changed after high load caused by chemical change of carbon dioxide ($CO_2$) fluid has occurred, so that sudden RPM change generated in the high-pressure ratio operation may reduce durability of a frictional surface of the compressor unit. In this case, when technology (e.g., hardening of frictional material, heat treatment of a bearing, etc.) for preventing degradation of the durability of the compressor is used, the cost of materials may unavoidably increase. In the third vulnerability, since the design (fixed) compression ratio of the compressor should be considered, the mode conversion pressure setting range is limited, load may be inevitably concentrated on a specific compression stage (1-stage or 2-stage) without accurate load distribution. Accordingly, the system for use in the washing machine can be implemented in other ways in consideration of the above-described technical disadvantages.

Figure 19:
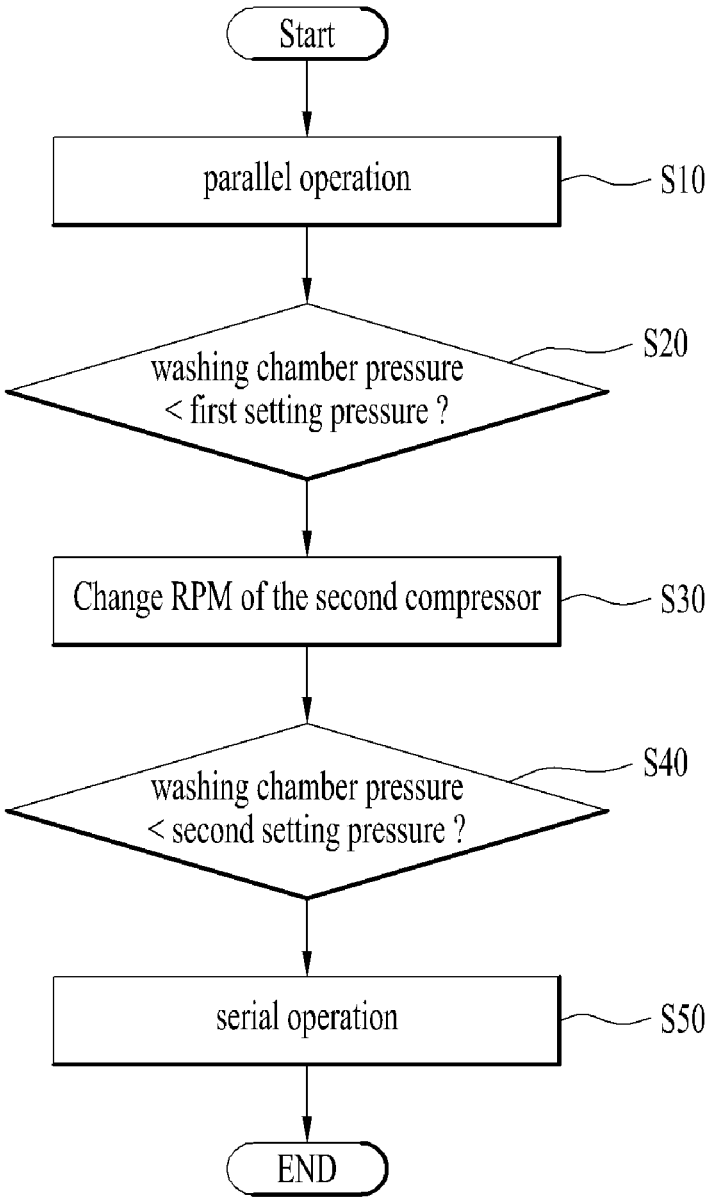
FIG. 19 is a flowchart illustrating an operation process of the washing machine.

FIG. 19 is a flowchart illustrating an operation process of the washing machine.

In the implementation of FIG. 19, when using a plurality of compressors (or multistage compressors) with the same capacity is used, it is assumed that total load is divided equally into the compressors (compression stages). In this case, load of a single compressor is represented by shaft torque. In addition, if the same amount of fluid passes through the respective compressors during the serial operation mode, torque may be proportional to the compressor pressure ratio (=discharge pressure/inlet pressure). For example, in order to maximize the operation efficiency of the compressor in the system designed to use a volumetric compressor, it is very important for the compression ratio of the first compressor and the compression ratio of the second compressor to be implemented in the same operation condition. However, it is practically impossible for the compressor having a fixed design compression ratio to have the same compression ratio in real time under all available situations. Therefore, from the viewpoint of compressor protection, the use of the first criterion in which the pressure ratio is equally selected as the worst condition, and the use of the second criterion in which the compressor pressure ratio designed to increase to a higher-temperature level is set to a lower pressure ratio may be considered advantageous in terms of durability guarantee. In other words, lowering the pressure ratio of the compressor located at a high-pressure stage may be considered advantageous in terms of durability lifespan.

In most of washing machines each having a limited intercooler size, a discharge temperature of the high-pressure stage compressor (i.e., second compressor 84) in a two-stage compression mode is higher than the discharge temperature of the low-pressure stage compressor (i.e., first compressor 82) in the two-stage compression mode. For example, the pressure ratio of the second compressor 84 is set to 4.9 and the second compressor 84 is driven at the pressure ratio of 4.9, and the pressure ratio of the first compressor 82 is set to 5.2 and the first compressor 82 is driven at the pressure ratio of 5.2. As a result, a relatively smaller load is applied to the second compressor 84 located at the high-pressure stage, so that durability of the compressor can be guaranteed.

Referring to FIG. 19, when washing is finished, the first compressor 82 and the second compressor 84 are arranged in parallel to compress carbon dioxide, so that the compressed carbon dioxide can be guided to the storage tank 30 (S10). In some implementations, two compressors have the same capacity, and the compression efficiency is high, so that a time taken to perform such compression can be shortened.

TABLE 1

| Washing chamber pressure (barA) | Operation mode | RPM of First Compressor [rpm] | RPM of Second Compressor [rpm] |
|---|---|---|---|
| 40 → 14(=P1(First setting pressure)) | Parallel | 6500 | 6500 |
| 14 → 13(=P2(Second setting pressure) | Parallel | 6500 | 2500 |
| 13 → 2.5 | Serial | 6500 | 2500 |

Since the washing chamber pressure is the same as the internal pressure of the drum, the terms "washing chamber pressure" and "drum internal pressure" will be used interchangeably. The drum is disposed in the washing chamber because portions where the two components are disposed have the same pressure.

When the washing chamber pressure, i.e., the drum internal pressure, is lowered by a first setting pressure P1, the rpm of the second compressor 84 can be changed (S20, S30). Two compressors can be operated in parallel until the drum internal pressure drops to the first setting pressure (e.g., 14), but the two compressors may be kept at the same rpm.

Since the carbon dioxide of the washing chamber 10 is continuously compressed during operation of the two compressors, the internal pressure of the washing chamber can be continuously reduced.

When the drum internal pressure is reduced by a second setting pressure (P2, for example 13), the first compressor 82 and the second compressor 84 can be arranged in series to compress carbon dioxide (S40, S50). In some implementations, whereas the rpm of the first compressor 82 is identical to the initial rpm, the rpm of the first compressor 82 can be kept low.

For example, the two compressors can be operated in parallel at the same rpm until the drum internal pressure drops to the first setting pressure.

When the drum internal pressure reaches the first setting pressure, the rpm of the second compressor 84 can be lowered compared to the conventional rpm in a situation where the parallel operation is maintained.

When the drum internal pressure reaches a second setting pressure, the parallel mode can switch to the serial operation. In some implementations, the rpm of the first compressor 82 and the rpm of the second compressor 84 can be maintained at previous rpms of the first compressor 82 and the second compressor 84, so that each of the first compressor 82 and the second compressor 84 can be prevented from being overloaded when the parallel operation switches to the serial operation.

The first setting pressure P1 may be greater than the second setting pressure P2. This is because, as the compressor is driven, carbon dioxide of the washing chamber moves from one place to another place, so that the internal pressure of the washing chamber can also be reduced.

In some implementations, during the process of moving the carbon dioxide from the washing chamber to the storage tank after completion of laundry washing, the rpm of the first compressor 82 from among two compressors is maintained at the same rpm, so that operation stability can be guaranteed in the process of driving the first compressor 82.

Until the drum internal pressure is reduced by the second setting pressure P2, the first compressor and the second compressor can be operated in parallel to prevent the amount of compression of carbon dioxide from decreasing. For reference, when two compressors are operated in series, whereas carbon dioxide can be compressed at a high pressure, but the amount of compressed carbon dioxide can decrease.

When the drum internal pressure is reduced by the first setting pressure P1, the rpm of the second compressor can be reduced so that the risk of high load generated by serial arrangement of two compressors can be reduced.

Figure 20:
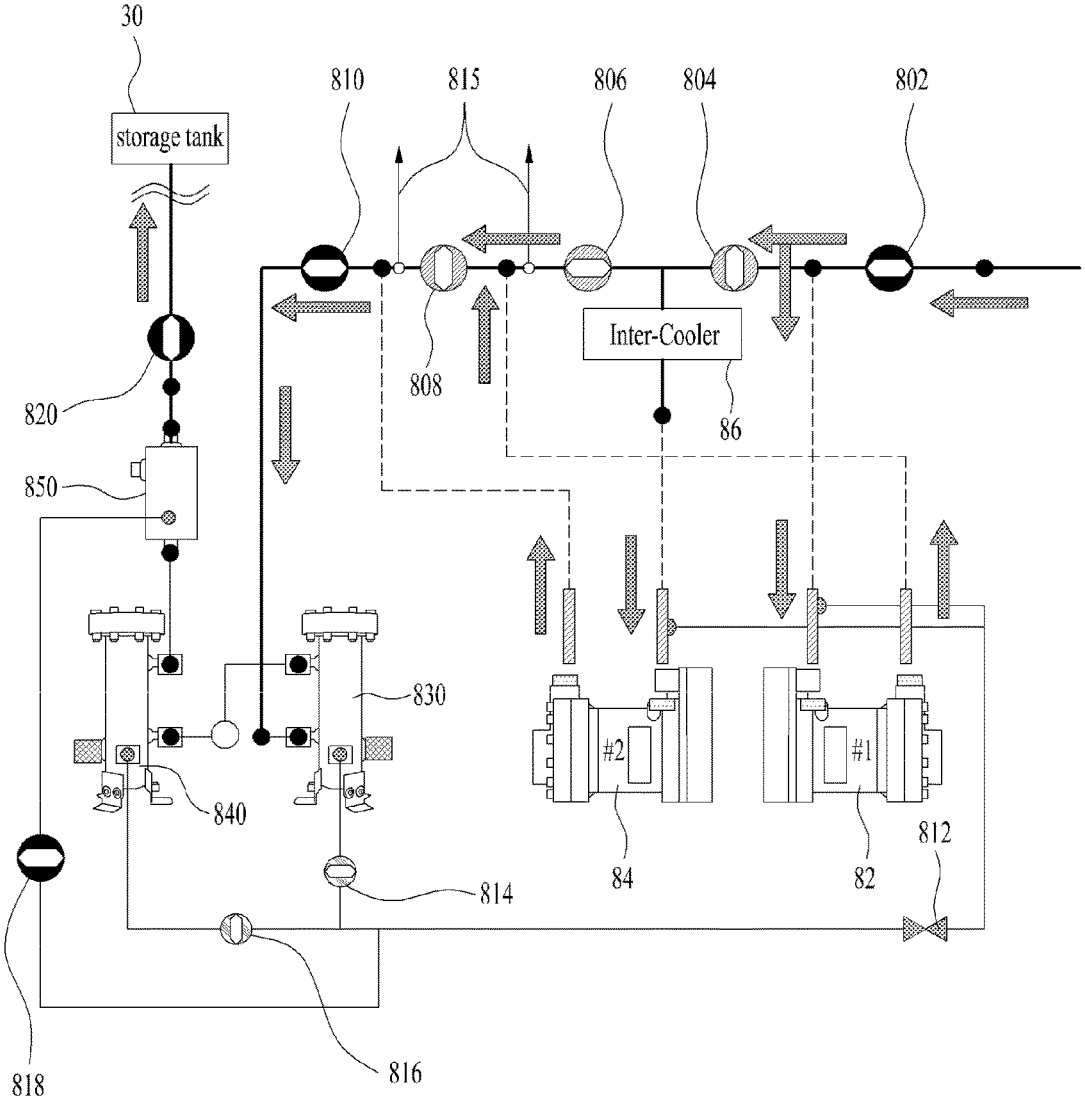
FIGS. 20 and 21 are diagrams illustrating exemplary features in which two compressors are operated in parallel.
Figure 21:
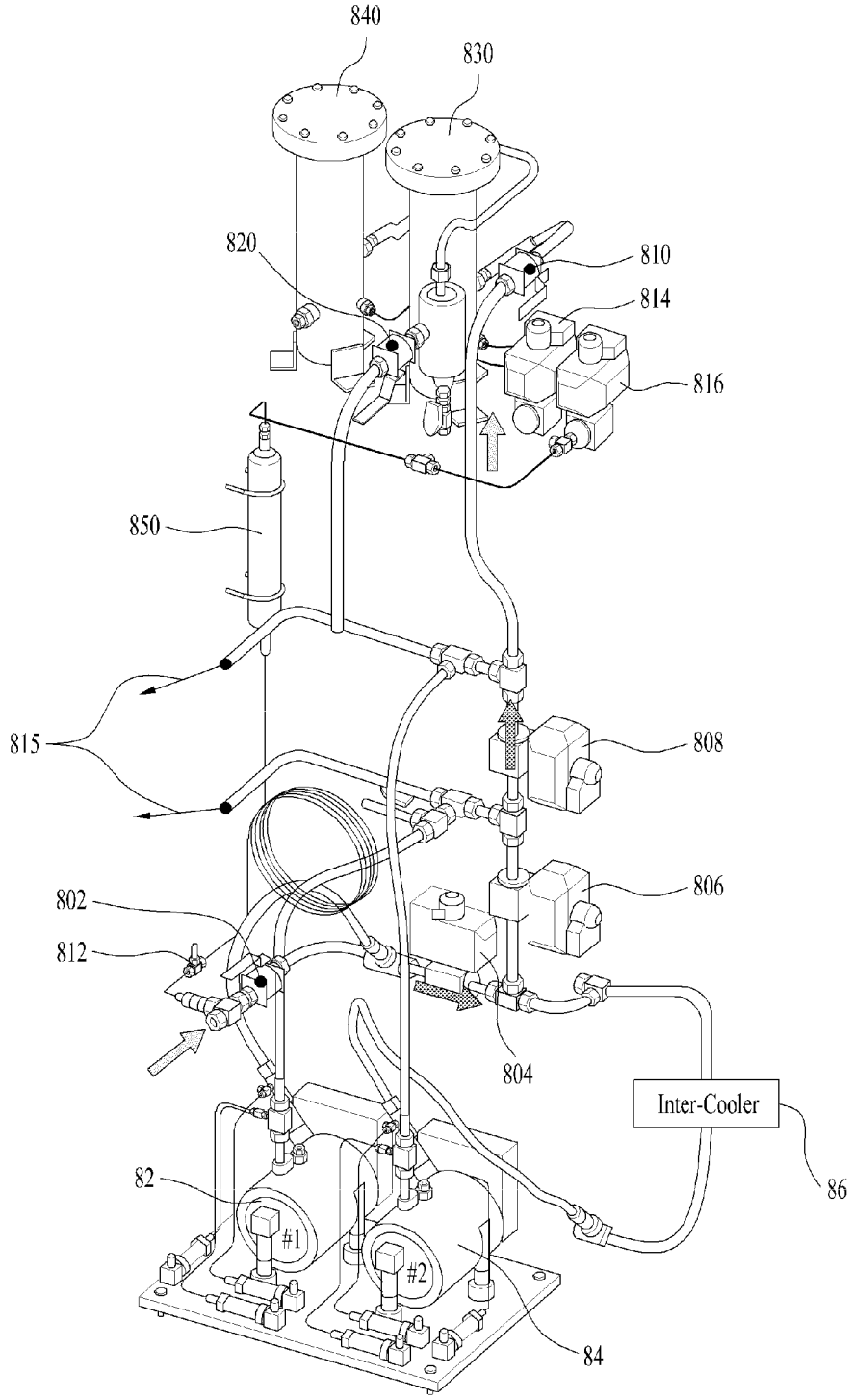
Figure 22:
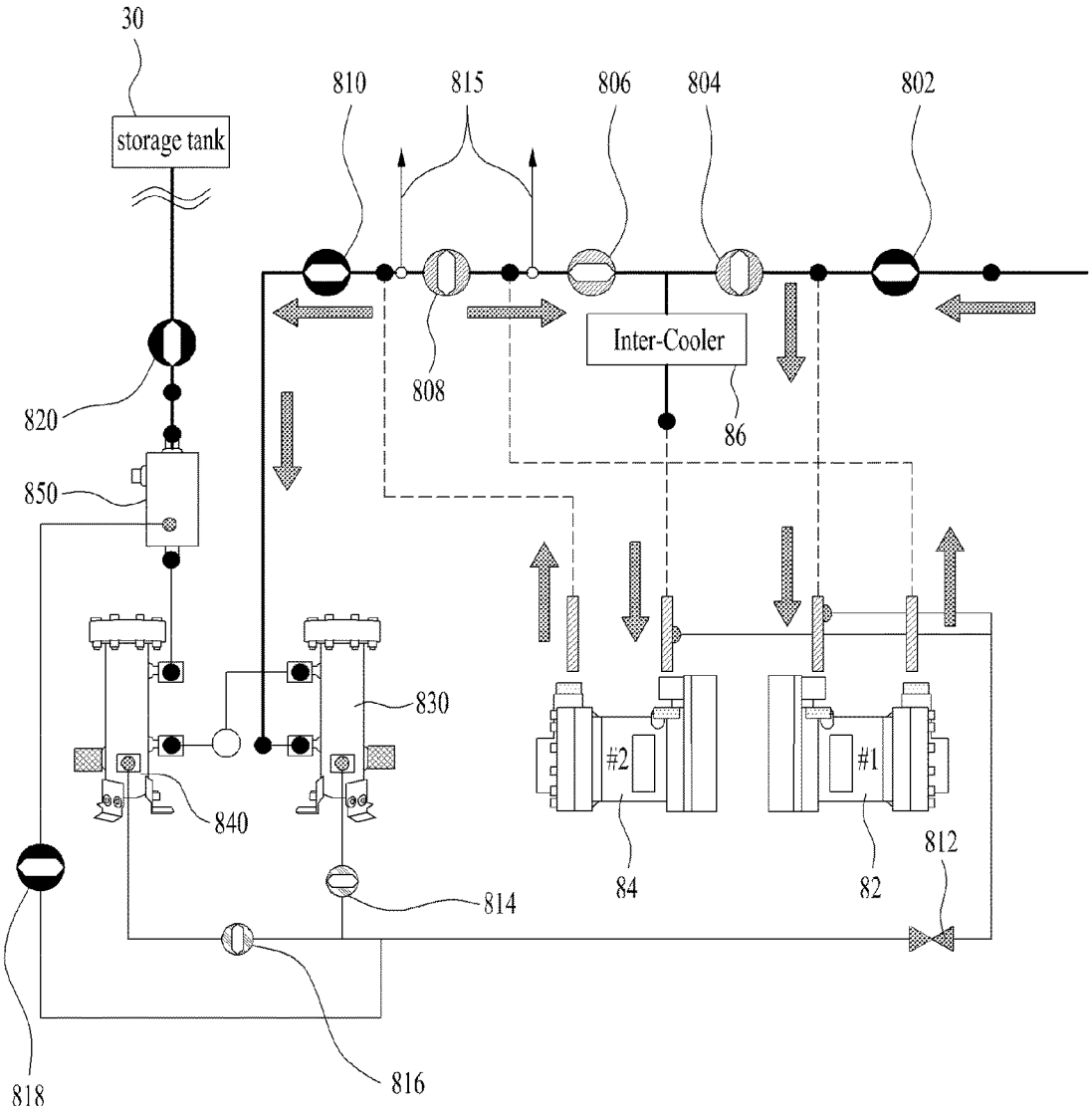
FIGS. 22 and 23 are diagrams illustrating exemplary features in which two compressors are operated in series.
Figure 23:
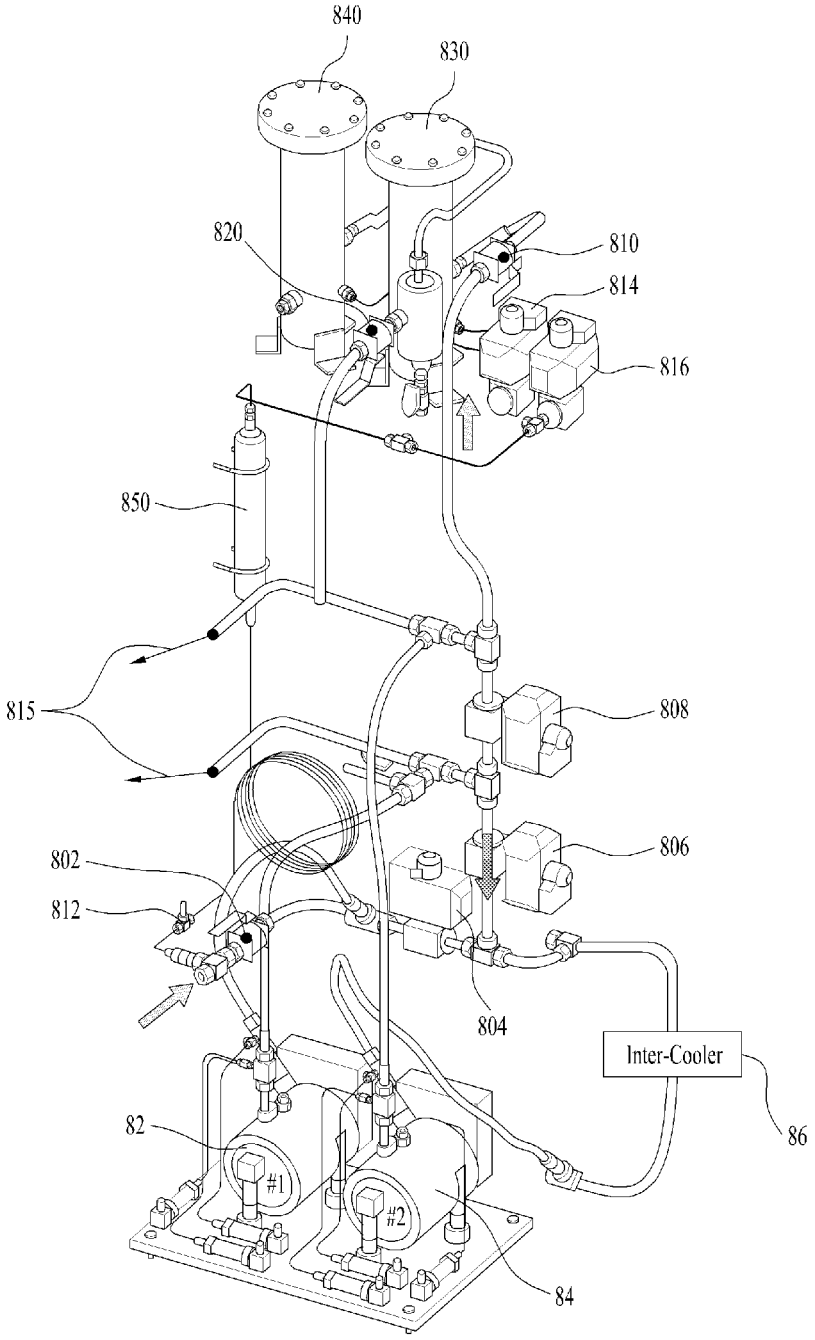

FIGS. 20 and 21 are diagrams illustrating exemplary features in which two compressors are operated in parallel. FIGS. 22 and 23 are diagrams illustrating exemplary features in which two compressors are operated in series.

FIGS. 20 and 22 are conceptual diagrams illustrating a path through which carbon dioxide flows, and FIGS. 21 and 23 are diagrams illustrating actual implementation states.

The two compressors 82 and 84 are disposed separately from each other, and manual valves (also called hand valves) 802, 810, 818, 820 are disposed. The manual valves may allow the user to open or close a flow passage.

Valves 804, 806, 808, 814, and 816 capable of opening or closing the flow passage according to a system state can be installed. Oil separators 830 and 840 and the oil reservoir can be installed on the path through which carbon dioxide flows. The oil separators and the oil reservoir can separate oil to be discharged with carbon dioxide from the compressor, and can store the separated oil.

In some implementations, when the valve 818 installed in the flow passage through which oil is drained from the oil reservoir is opened, or when the valves 814 and 816 installed in the flow passage through which oil is drained within the oil separators are opened, the stored oil can return to the compressor. In some implementations, the stored oil can also pass through a metering valve 812 as needed.

The flow passage through which carbon dioxide compressed by the first compressor 82 and the second compressor 84 is discharged can include a flow passage 815 in which a safety valve is installed, so that the carbon dioxide is prevented from being excessively compressed and excessive increase of such pressure can also be prevented.

In addition, the intercooler 86 can be disposed to lower a temperature of the compressed carbon dioxide when a multistage compression mode is performed. In addition, when the parallel operation is performed, the temperature of carbon dioxide introduced into the second compressor 84 can be lowered, so that the second compressor 84 can be prevented from heating up to a high temperature.

A method for performing the parallel operation will hereinafter be described with reference to FIGS. 20 and 21. Carbon dioxide of the washing chamber 10 can be provided after passing through the manual valve 802. In some implementations, the flow passage through which carbon dioxide is supplied based on the manual valve 802 and the other flow passage formed to pass through the manual valve 802 can be separated from each other.

In some implementations, carbon dioxide passing through the manual valve 802 is guided to the suction passage of the first compressor 82, and is discharged to the outlet passage. Since the valve 802 is in a state where the flow passage is opened, carbon dioxide having penetrated the manual valve 802 passes through the intercooler 86 and is compressed by the second compressor 84, so that the compressed carbon dioxide can be discharged.

Since the valve 808 is in a state where the flow passage is opened, carbon dioxide compressed by the first compressor 82 and carbon dioxide compressed by the second compressor 84 can simultaneously move toward the flow passage opened by the valve 818.

In some implementations, the valve 806 is in a state where the flow passage is closed, so that carbon dioxide cannot move after passing through the valve 806.

Carbon dioxide having penetrated the manual valve 810 can sequentially pass through the first oil separator 830, the second oil separator 840, and the oil reservoir 850, so that oil mixed with the carbon dioxide can be separated (or isolated).

During the compression process by the compressors 82 and 84, oil used in the compressors 82 and 84 may be mixed with carbon dioxide. If the oil is mixed with carbon dioxide, there is a possibility that laundry is contaminated with oil during washing of the laundry, so that there is a need for oil to be separated from carbon dioxide to be reused.

The carbon dioxide having passed through both the oil separator and the oil reservoir can flow into the storage tank 30 after passing through the manual valve 820, so that the resultant carbon dioxide can be stored in the storage tank 30. In some implementations, the upper side and the lower side of the washing machine can be separated from each other based on the manual valve 820, so that the upper portion and the lower portion of the washing machine can be separated from each other based on the manual valve 820 for facilitation of user manipulation.

The oil stored in the oil reservoir 850 can return to the compressor when the flow passage is opened by the manual valve 818.

In addition, oil separated by the first oil separator 830 can open the flow passage in the valve 814, and oil separated by the second oil separator 840 can flow into two compressors when the flow passage is opened by the valve 816.

In FIGS. 20 and 21, whereas each of the valve 804 and the valve 808 opens the flow passage, the valve 806 can block the flow passage through which carbon dioxide moves, so that two compressors can be operated in parallel.

Exemplary features for operating two compressors in series will hereinafter be described with reference to FIGS. 22 and 23.

Whereas the valve 804 and the valve 808 shown in FIGS. 20 and 21 block the flow passage, the valve 806 opens the flow passage through which carbon dioxide moves, so that two compressors can be operated in series.

Carbon dioxide guided from the washing chamber is compressed by the first compressor 82 after passing through the valve 802. In some implementations, since the valve 804 blocks the flow passage, all carbon dioxide can be guided to the first compressor 82 without passing through the valve 804.

Since the valve 808 blocks the flow passage and the valve 806 opens the flow passage, the carbon dioxide compressed in the first compressor 82 can flow into the flow passage passing through the valve 806 and can be cooled after passing through the intercooler 86. Subsequently, after the carbon dioxide is compressed by the second compressor 84, the carbon dioxide can move after passing through the manual valve 818.

The process for controlling two compressors to switch from the parallel operation to the serial operation can be implemented by opening/closing the flow passage in the valves 804, 806, and 808. When the operation condition is changed, the serial operation can switch to the parallel operation and the parallel operation can then switch to the serial operation by activation of the flow passage that is opened or closed by the respective valves. When the drum internal pressure is lowered by the second setting pressure P2, the flow passage of the carbon dioxide can be adjusted in a manner that the first compressor and the second compressor are arranged in series.

A process for returning oil from the oil separator and the oil reservoir will hereinafter be described with reference to FIGS. 20 to 23.

The present disclosure relates to a method for separating oil having leaked from the compressor and mixed with a washing solvent from the compressor and re-supplying the separated oil to the compressor, when the oil-supply-type compressor is used as a fluid machine capable of recovering and regenerating the carbon dioxide after completion of the washing course in the washing machine in which the carbon dioxide is used as a washing solvent. Also, the present disclosure relates to a method for completely removing oil mixed with the washing solvent so that laundry can be washed only using the washing solvent formed of pure carbon dioxide.

When recovery of the carbon dioxide is performed, one or more compressors can be operated in parallel or in series so as to form a high flow rate and a differential pressure. In some implementations, the oil can be smoothly supplied to the respective compressors through oil return valve control. In addition, the oil accumulated in the storage tank is bypassed without being separated from the oil separator, so that the oil can be removed from the washing solvent.

The present disclosure provides the oil-supply-type scroll compressor for implementation of a compact and economical carbon dioxide ($CO_2$) washing machine. For example, in order to form a high flow rate and differential pressure, one or more oil-supply-type scroll compressors are operated in series or in parallel. In some implementations, one or more oil separators can be used to increase separation efficiency of oil having leaked from the compressor.

In some implementations, the oil-supply-type scroll compressor is used so that volume can be reduced by about 60% as compared to the other case in which the oil-less compressor is used.

In some implementations, in order to supply oil to one or more compressors, a plurality of oil separators is installed, and the separated oil is recirculated using the compressor(s). The plurality of oil separators can be arranged in series, and carbon dioxide including the oil can sequentially pass through the plurality of oil separators, resulting in an increase in oil separation efficiency.

In some implementations, the oil filtered by the respective oil separators is collected into a reservoir so that the collected oil can then be returned to the compressor. In some implementations, the amount of returned oil can be measured by calculating the flow rate using oil flowmeter installation or pressure sensing. The amount of oil leakage in the compressor can be measured by the OCR meter or the L-$CO_2$ extraction method. The amount of returned oil can also be determined in a manner that the appropriate amount of oil can be maintained in the oil separator (or the oil reservoir).

The oil separated in the oil separator is supplied to the carbon dioxide suction line of each compressor through a valve. In order to uniformly supply oil to the respective compressors in the system to which one or more compressors are applied, an oil return pipe can be connected to an inlet of a main pipe through which carbon dioxide flows or can be disposed among the compressor, the washing tub, and a distillation tank. In some implementations, the oil supply line can also be installed in each compressor as needed.

When the plurality of compressors is operated in parallel, only the oil stored in the first oil separator 830 can be returned as needed. Since the first oil separator 830 is an oil separator at which oil having passed through the compressor first arrives, there are a large amount of flowing carbon dioxide, so that the large amount of oil leakage may also occur.

When the plurality of compressors is operated in series, only oil stored in the second oil separator 840 can be returned as needed. A serial operation time is shorter than a parallel operation time, so that the use of the oil of the second oil separator 840 is considered sufficient.

In addition, after several washing processes are completed, the oil accumulated in the oil reservoir 850 can be returned through the third valve 818. Unlike the first valve 814 or the second valve 816, the third valve 818 can be designed in a manner that the flow passage is not opened or closed according to a specific condition, the flow passage is opened or closed by the user so that the stored oil can return to the compressor.

The first oil separator 830 can separate the oil from the carbon dioxide compressed by the first compressor and the second compressor. The oil separated by the oil separator 830 may flow into the compressor through the first valve 814 for opening or closing the flow passage through which the oil is guided to the first compressor or the second compressor.

The second oil separator 840 can separate oil from the carbon dioxide having passed through the first oil separator 830. The oil separated by the second oil separator 840 can be guided to the compressor through the second valve 818 for opening/closing the flow passage through which the separated oil is guided to the first compressor or the second compressor.

The oil reservoir 850 can separate oil from the carbon dioxide having passed through the second oil separator 840, and may store the separated oil therein. The oil stored in the oil reservoir 850 may be returned to the compressor through the third valve 818 that opens and closes a flow path through which the oil stored in the oil reservoir 850 is guided to the first compressor or the second compressor.

In some implementations, the first valve 814 can open the flow passage while the first compressor and the second compressor are operated in parallel, so that the oil can return to the compressor. In some implementations, the first valve 814 can close the flow passage while the first compressor and the second compressor are operated in series, so that the oil is not returned to the compressor.

While the first compressor and the second compressor are operated in parallel, the second valve 816 can close the flow passage to block returning of the oil. In contrast, while the first compressor and the second compressor are operated in series, the second valve 816 can open the flow passage so that the oil can be returned to the compressor.

The amount of oil filtered by the first oil separator 830 is greater than that of the second oil separator 840. This is because the carbon dioxide having passed through the compressor passes through the first oil separator before being guided to the second oil separator.

Therefore, since parallel operation is conducted for a longer period of time than serial operation, the oil filtered by the first oil separator 830 is guided to the compressor, so that the sufficient amount of oil can be supplied to the compressor.

In some implementations, the oil separators to be used for oil returning are used in different ways according to the serial operation and the parallel operation, so that the oil can be relatively evenly returned.

The third valve 818 can be constructed in a manner that the washing cycle is continuously performed two or more times and the flow passage is opened after completion of such washing cycle so that the oil can be returned to the compressor.

When each of the first valve, the second valve, and the third valve opens the flow passage, the other valves may not open the flow passage so that the oil can be individually supplied to each of the compressors. For example, when oil is returned from the first valve, the second valve and the third valve can block returning of the oil. As the other valves operate similarly, the oil can be evenly returned to the compressors.

Figure 24:
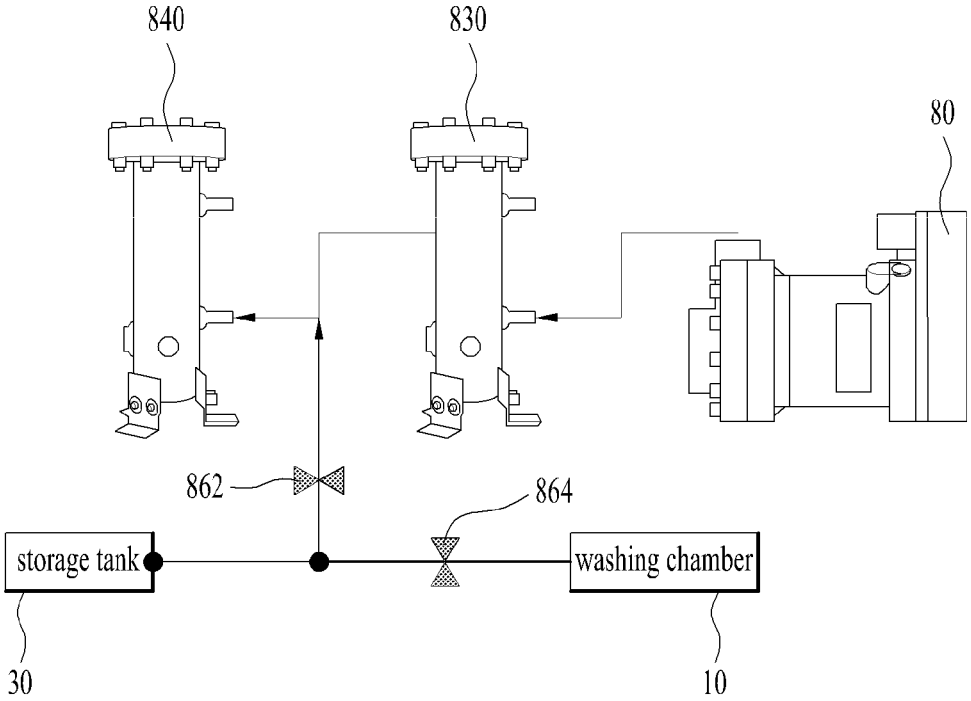
FIG. 24 is a diagram illustrating a path through which oil trapped in a storage tank or a washing chamber flows.

FIG. 24 is a diagram illustrating a path through which oil trapped in the storage tank or the washing chamber flows.

The storage tank can store carbon dioxide. As the storage time increases, oil having a relatively large specific gravity may sink. Therefore, the oil accumulated at the bottom may be guided to a gap between the first oil separator 830 and the second oil separator 840, so that the oil can be filtered through the second oil separator 840.

In some implementations, the valve 864 is provided, so that the flow passage can be opened by the valve 864 only when there is a need to filter the oil stored in the storage tank 30.

In some implementations, the valve 864 and the valve 862 are simultaneously used to open the flow passage, so that the oil stored in the washing chamber 10 can be filtered by the second oil separator 840.

The oil collected in the storage tank 30 sinks under the storage tank 30 due to a specific gravity (density) difference and is then bypassed to a third space rather than the washing chamber during a short period of time. Thus, the oil mixed with the carbon dioxide washing solvent supplied to the washing chamber can be recovered.

In some implementations, the storage tank 30 is disposed to be inclined toward one side, so that the oil stored in the storage tank 30 may be collected at the inclined lower portion. The oil moved in a relatively downward direction is separated from the carbon dioxide, so that laundry can be blocked from being contaminated by the oil during washing.

Figure 25:
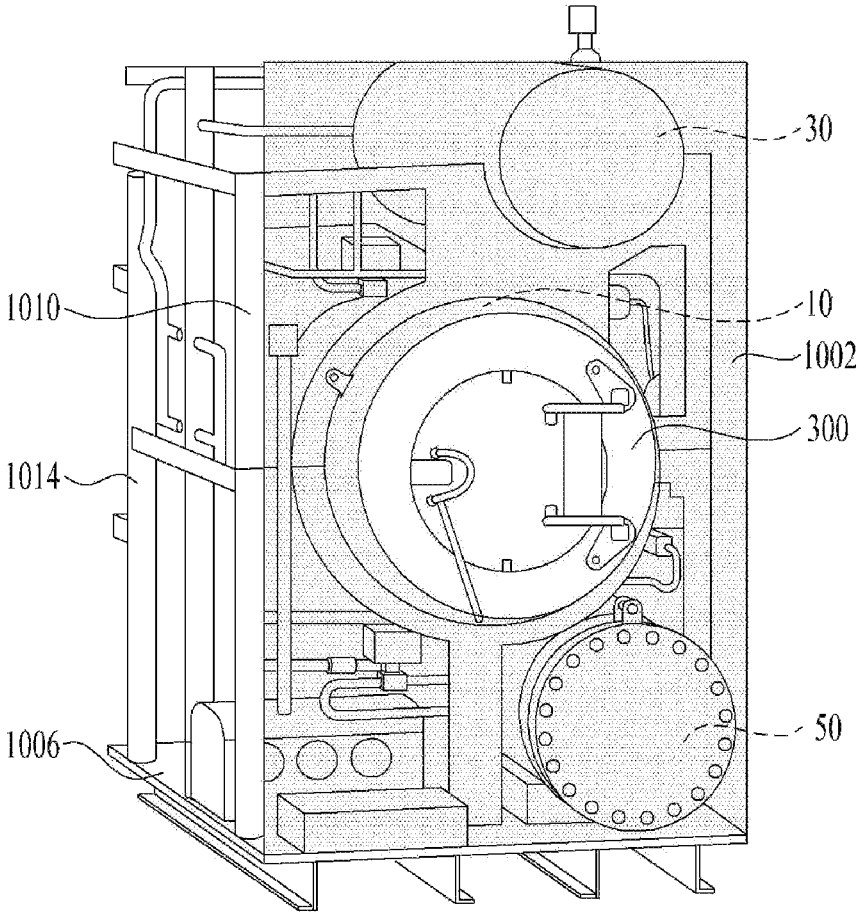
FIG. 25 is a diagram illustrating a front view of an exemplary washing machine.
Figure 26:
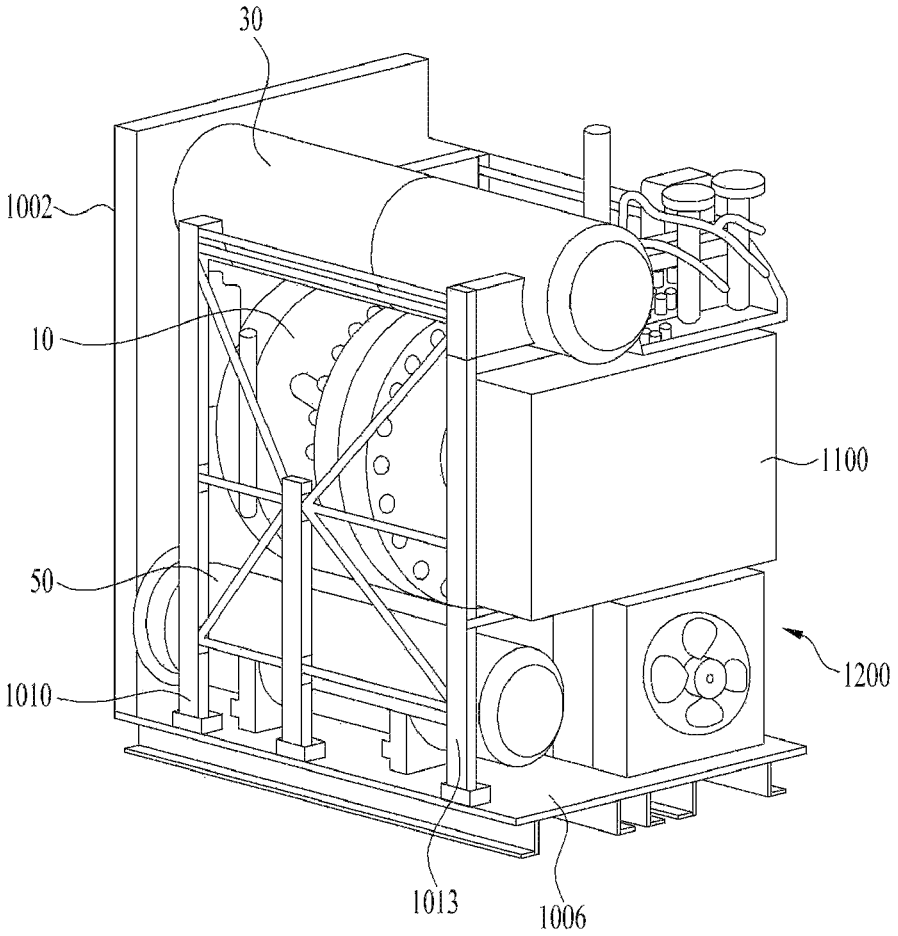
FIGS. 26 and 27 are diagrams illustrating rear views of the exemplary washing machine shown in FIG. 25.
Figure 27:
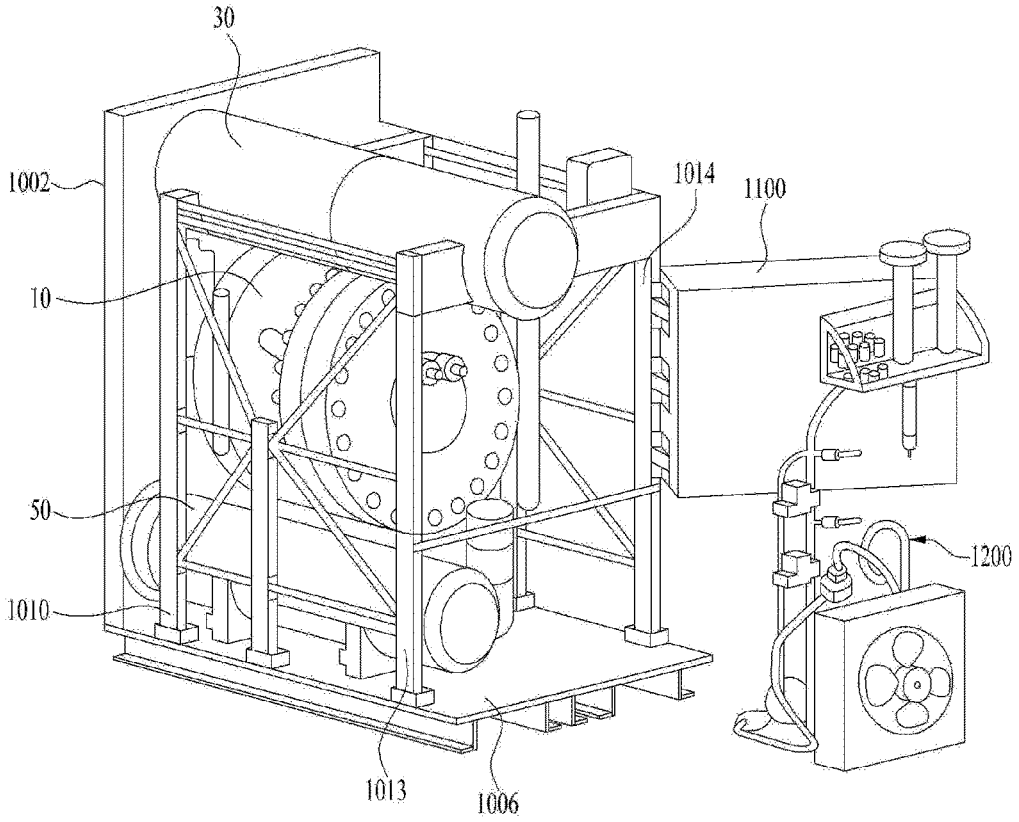

FIG. 25 is a diagram illustrating a front view of the exemplary washing machine. FIGS. 26 and 27 are diagrams illustrating rear views of the exemplary washing machine shown in FIG. 25.

The present disclosure provides technology for enabling the electronic module to be rotatably mounted to the washing machine so that a separate operation can be performed as needed. The compressor oil separator, the intercooler, the pipes, etc. are modularized, so that the corresponding component can be maintained and repaired alone, and exhausting, filling, and vacuuming of the carbon dioxide can be performed. In addition, in a situation where each of the storage tank storing the large amount of carbon dioxide, the distillation chamber, the washing chamber, etc. is kept in a fully filled state, each of the storage tank, the distillation chamber, the washing chamber, etc. can be maintained and repaired.

The present disclosure provides a washing machine in which carbon dioxide is used as a washing solvent. In this washing machine, the electronic panel may rotate by 180° with respect to one axis of a back surface of the washing machine, so that self-inspection of various sensors mounted in the washing machine, program update, signal system inspection, etc. can be performed.

In addition, the compressor, the oil separator, pipes, etc. of the washing machine are modularized in a manner that each component of the washing machine can be independently separated from the system, so that exhausting, vacuuming, and charging of carbon dioxide can be performed independently.

In the present embodiment, the overall appearance of the washing machine will be described. The washing machine can include a frame forming an appearance thereof, a washing chamber 10 installed in the frame, a storage tank 30 for storing carbon dioxide to be supplied to the drum, a distillation chamber 50 for separating contaminants dissolved in liquid carbon dioxide, an electronic unit 1100 in which the electric devices are installed, and a configuration unit 1200.

The configuration unit 1200 may refer to a configuration shown in FIGS. 22 to 24, and a redundant description thereof will herein be omitted for convenience of description.

In contrast, the configuration unit 1200 can include one or more pipes through which carbon dioxide moves; first and second compressors 82 and 84, each of which compresses the carbon dioxide discharged from the drum after completion of laundry washing and allowing the compressed carbon dioxide to flow into the storage tank; and oil separators 830 and 840 for separating the oil from carbon dioxide compressed in each of the first and second compressors.

The electronic unit 1100 can include a printed circuit board (PCB) substrate, can generate a control signal for driving each valve, and can perform various commands according to a user input. The electronic unit 1100 can receive external power, so that the electronic unit 1100 can be powered on.

All components of the washing machine can be installed in the frame. Accordingly, if only a space in which the frame can be installed is guaranteed, the washing machine can be installed in the space.

The frame can include a front panel 1002 provided on the front side, a bottom panel 1006 provided on the floor, and columns 1014, 1013, and 1010 vertically coupled to the bottom panel 1006.

The column can include a front column 1010 located adjacent to the front panel 1002, and a rear column located opposite to the front panel 1002. The rear column can include a first rear column 1013 and a second rear column 1014. The first rear column 1913 and the second rear column 1014 are spaced apart from each other, so that the first rear column 1913 and the second rear column 1014 can be located at a rear vertex side of the bottom panel.

The front panel 1002 can be disposed perpendicular to the bottom panel 1006, and can be arranged in a rectangular shape at the front edge of the bottom panel 1006.

An opening can be provided in the front panel 1002, and the door 300 can be disposed in the opening. As the door 300 is opened, the user can put laundry into the washing chamber 10 or can take laundry out of the washing chamber 10. The door 300 is coupled to the front panel 1002, so that the user can handle the door 300 without approaching the side surface of the washing chamber 10.

The bottom panel 1006 can have a rectangular shape so that various components can be supported. In addition, a plurality of ribs can be disposed at a lower portion of the bottom panel 1006, thereby reinforcing the bottom panel 1006. The plurality of columns can be spaced apart from each other with respect to the bottom panel 1006, so that various components can be supported by the columns.

The electronic unit 1100 can be rotatably coupled to the second rear column 1014. As shown in FIG. 27, the electronic unit 1100 can rotate with respect to the second rear column 1014, and can be selectively coupled to the first rear column 1013 as shown in FIG. 26. Therefore, when maintenance is required for the electronic unit 1100, the electronic unit 1100 can be separated from the first rear column 1013 as shown in FIG. 27, so that the separated electronic unit rotates. After such maintenance is completed, the electronic unit 1100 can be rotated to be coupled to the first rear column 1013.

The configuration unit 1200 can be constructed in a manner that the respective components are disposed on the upper side and the lower side of the electronic unit 1100. For example, among the components included in the configuration unit 1200, the oil separator can be disposed at the upper side of the electronic unit 1100, and the compressor is disposed at the lower side of the electronic unit 1100. Therefore, if maintenance of the configuration unit 1200 is required, the electronic unit 1100 can rotate so that a working space can be guaranteed.

In some implementations, a portion corresponding to the manual valve from among the components included in the configuration unit 1200 can be separated from the washing machine by modularizing the manual valve separated by the user. A detailed description thereof will herein be omitted as previously described.

Each of the distillation chamber 50, the storage tank 30, and the washing chamber 10 can have a cylindrical shape, and can be placed in a lying state so that a vertical cross-section of each of the distillation chamber 50, the storage tank 30, and the washing chamber 10 can have a circular shape. Therefore, the space occupied by the washing machine can be reduced in size by the chamber and the tank, resulting in reduction in overall size of the washing machine.

Among the distillation chamber 50, the storage tank 30, and the washing chamber 10, the washing chamber 10 can be formed to have the largest radius. The washing chamber 10 can be designed in a manner that the drum disposed therein rotates and laundry is accommodated in the drum, so that the washing chamber 10 can occupy a relatively large space.

The washing chamber 10 is disposed at the center of the front panel 1002 in the width direction. For example, the washing chamber 10 is disposed at the center of the front panel 1002 in a horizontal direction when viewed from FIG. 25. Since the washing chamber 10 has the largest radius, it is preferable that the washing chamber 10 be first disposed at the center of the front panel 1002, and arrangement of other components be then determined, resulting in an increase in space use efficiency. In addition, vibration occurs in the washing chamber 10 due to rotation of the motor, so that the washing chamber 10 can be disposed at the center of the frame, resulting in prevention of resonance or the like.

The storage tank 30 and the distillation chamber 50 can be disposed to be biased toward one side with respect to a width direction. In particular, the storage tank and the distillation chamber can be arranged to be biased in the same direction with respect to the washing chamber. Referring to FIG. 25, the storage tank and the distillation chamber can be disposed on the right side with respect to the washing chamber 10.

The washing chamber 10 can be disposed between the distillation chamber 50 and the storage tank 30. The distillation chamber 50 can be disposed at the lowest position among the distillation chamber, the storage tank, and the washing chamber. The storage tank 30 can be disposed at the highest position among the distillation chamber, the storage tank, and the washing chamber.

For example, the storage tank 30 is disposed at the highest position with respect to the front panel 1002, and the washing chamber 10 is disposed below the storage tank 30, and the distillation chamber 50 is then disposed below the washing chamber 10.

The carbon dioxide used in the washing chamber 10 may be disposed at a lower portion of the washing chamber 10, so that the carbon dioxide can move toward the distillation chamber 50 due to gravity and can then be filtered in the distillation chamber 50.

The storage tank 30 can be supported by the front column 1010 and the rear column 1013.

In some implementations, the washing chamber can have a cylindrical shape having a shorter length than the storage tank 30 or the distillation chamber 50, so that the electronic unit 1100 can be located at a height where the washing chamber 10 is located. The electronic unit 1100 can include a plurality of components such as a PCB, a space capable of including the plurality of components is required. Since the length of the washing chamber 10 is short, the space for enabling the electronic unit 1100 to be disposed in the frame can be guaranteed. In some implementations, the electronic unit 1100 is formed in an approximately rectangular parallelepiped shape, and the components are arranged in the corresponding rectangular parallelepiped space, and there occurs no interference with other components in the frame.

In some implementations, when maintenance is required for the washing chamber 10, the electronic unit 1100 rotates as shown in FIG. 27 so that a work (or task) space for the washing chamber 10 can be guaranteed. In addition, after completion of the task or work, the electronic unit 1100 returns to its original position as shown in FIG. 26, so that the space occupied by the washing machine can be reduced in size.

Since the washing chamber 10 is disposed between the distillation chamber 50 and the storage tank 30, the side surface and the back surface of the washing chamber 10 may be exposed to the user. Therefore, when maintenance is required for the distillation chamber or the storage tank, the user can access the distillation chamber 50 or the storage tank 30 without the necessity of removing other components from the washing machine.

As is apparent from the above description, the washing machine can include constituent elements arranged for easy maintenance. Thus, when maintenance is required for a specific constituent element, inconvenience of a user who has to attach/detach other constituent elements can be eliminated. In addition, a tank or chamber having a relatively large volume can be stably distributed to reduce noise or vibration generated in the washing machine.

The washing machine can reduce the amount of carbon dioxide to be used so that the amount of residual carbon dioxide to be reprocessed after use can also be reduced, resulting in improvement in energy efficiency of the entire system. In addition, since the amount of carbon dioxide to be used is reduced, the size of a storage tank that should store carbon dioxide before use can also be reduced, so that the overall size of the washing machine can be reduced.

For example, the amount of carbon dioxide to be used in the washing machine can be reduced as compared to the conventional washing machine, so that the amount of carbon dioxide to be reprocessed after use can also be reduced. As the amount of carbon dioxide to be used is reduced, the overall size of the washing machine for using carbon dioxide as well as the capacity of a storage tank storing carbon dioxide can be reduced. In addition, since the amount of carbon dioxide to be reprocessed after use is reduced, the time required to perform washing or rinsing can also be reduced.

The washing machine can be constructed in a manner that various constituent elements can be separated from the washing machine so that an operator (or a repairman) can easily access and repair a necessary constituent component from among the constituent elements. In addition, the washing machine provides a structure in which various constituent elements can be combined to produce an actual product, so that the operator can easily manufacture the washing machine designed to use carbon dioxide.

The washing machine can include a stator and a rotor disposed together around a rotary shaft configured to rotate the drum, and the space to be occupied by a motor assembly is reduced in size, so that the overall size of the washing machine can also be reduced. In addition, the coupling relationship of the constituent elements for rotating the drum is simplified, so that noise generated by rotation of the drum can be reduced and the efficiency of power transmission can increase.

In some implementations, whereas liquid carbon dioxide is not introduced into the driving space in which the motor is disposed, gaseous carbon dioxide can flow into the driving space, and the drum can be rotated in a state in which pressure equilibrium between the washing space and the driving space is maintained. Therefore, when the washing machine operates, the drum can stably rotate. In addition, since the driving space is filled with gaseous carbon dioxide, the amount of carbon dioxide to be used for laundry treatment such as washing can be reduced.

In some implementations, liquid carbon dioxide discharged into the storage tank does not generate a large change in the storage level of liquid carbon dioxide stored in the storage tank, so that the storage level of the liquid carbon dioxide stored in the storage tank can be accurately detected.

What is claimed is:

1. A washing machine comprising:
- a frame defining an appearance of the washing machine;
- a drum configured to receive laundry;
- a washing chamber including:
  - a first housing defining an opening and a space into which the drum is inserted,
  - a barrier that surrounds the opening and that is coupled to the first housing, and
  - a second housing that surrounds a first surface of the barrier and that is coupled to the first housing;
- a storage tank configured to receive carbon dioxide to be supplied to the drum;
- a distillation chamber configured to separate contaminants dissolved in liquid carbon dioxide;
- an electronic unit, implemented using an electronic circuit, that is coupled to the frame and configured to control operations of the washing machine; and
- a configuration unit including:
  - a pipe configured to move the carbon dioxide,
  - a first compressor and a second compressor that are configured to compress the carbon dioxide discharged after washing is completed in the drum and that are configured to move the compressed carbon dioxide into the storage tank, and
  - an oil separator configured to separate oil from the carbon dioxide compressed in the first compressor and the second compressor,
- wherein the frame includes:
  - a front panel provided on a front surface of the frame,
  - a bottom panel provided on a bottom surface of the frame, and
  - a column coupled to the bottom panel and extending from the bottom panel in a vertical direction.

2. The washing machine according to claim 1, wherein: the electronic unit is rotatably coupled to the column.

3. The washing machine according to claim 2, wherein the column includes:
- a front column, and
- a rear column located opposite to the front panel with respect to the front column,
- wherein a distance from the front column to the front panel is less than a distance from the rear column to the front panel, and
- wherein the rear column includes a first rear column and a second rear column.

4. The washing machine according to claim 3, wherein: the electronic unit is rotatably coupled to the second rear column and is detachably coupled to the first rear column.

5. The washing machine according to claim 3, wherein: the storage tank is supported by the front column and the rear column.

6. The washing machine according to claim 1, wherein: components of the configuration unit are respectively disposed at an upper side and a lower side of the electronic unit.

7. The washing machine according to claim 1, further comprising:

a door through which the laundry is introduced into the washing chamber and coupled to the front panel.

8. The washing machine according to claim 1, wherein: each of the distillation chamber, the storage tank, and the washing chamber has a cylindrical shape, and a vertical cross-section of each of the distillation chamber, the storage tank, and the washing chamber has a circular shape.

9. The washing machine according to claim 8, wherein: the washing chamber has a largest radius among the distillation chamber, the storage tank, and the washing chamber.

10. The washing machine according to claim 9, wherein: the washing chamber is disposed at a center portion of the front panel with respect to a width direction of the washing machine.

11. The washing machine according to claim 9, wherein: a position of each of the storage tank and the distillation chamber is biased toward one side with respect to a width direction of the washing machine.

12. The washing machine according to claim 11, wherein: the position of each of the storage tank and the distillation chamber is biased in a same direction with respect to the width direction of the washing chamber.

13. The washing machine according to claim 8, wherein: the washing chamber is disposed between the distillation chamber and the storage tank.

14. The washing machine according to claim 13, wherein: the distillation chamber is disposed at a lowest position among the distillation chamber, the storage tank, and the washing chamber.

15. The washing machine according to claim 13, wherein: the storage tank is disposed at a highest position among the distillation chamber, the storage tank, and the washing chamber.

16. The washing machine according to claim 1, wherein: the barrier is configured to block liquid carbon dioxide injected into a first space provided by the first housing and the barrier from moving into a second space provided by the second housing and the barrier.

17. The washing machine according to claim 1, wherein: at least a portion of the configuration unit is disposed forward to the electronic unit.

18. The washing machine according to claim 1, wherein: the first compressor and the second compressor are disposed below the electronic unit.

19. The washing machine according to claim 1, wherein: at least a portion of the storage tank is disposed above the electronic unit.

20. The washing machine according to claim 1, wherein: revolutions per minute (RPM) of the first compressor and RPM of the second compressor are different from each other in a predetermined pressure range of the washing chamber.

* * * * *